US011729544B2

(12) United States Patent
Kikuchi et al.

(10) Patent No.: US 11,729,544 B2
(45) Date of Patent: Aug. 15, 2023

(54) INFORMATION OUTPUT DEVICE

(71) Applicant: SONY GROUP CORPORATION, Tokyo (JP)

(72) Inventors: Kohei Kikuchi, Tokyo (JP); Yushi Koyama, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 142 days.

(21) Appl. No.: 17/294,822

(22) PCT Filed: Oct. 15, 2019

(86) PCT No.: PCT/JP2019/040509

§ 371 (c)(1),
(2) Date: May 18, 2021

(87) PCT Pub. No.: WO2020/110490

PCT Pub. Date: Jun. 4, 2020

(65) Prior Publication Data

US 2022/0014837 A1 Jan. 13, 2022

(30) Foreign Application Priority Data

Nov. 27, 2018 (JP) ..... JP2018-221136

(51) Int. Cl.
*H04R 25/00* (2006.01)
*H04R 1/10* (2006.01)

(52) U.S. Cl.
CPC ..... *H04R 1/1066* (2013.01); *H04R 1/1091* (2013.01)

(58) Field of Classification Search
CPC .... H04R 1/105; H04R 1/1008; H04R 1/1041; H04R 1/1066; H04R 1/1075
See application file for complete search history.

(56) References Cited

U.S. PATENT DOCUMENTS 10,104,212 B2 * 10/2018 Meyberg ..... H01F 7/0263
2018/0152213 A1 5/2018 Lee et al.

FOREIGN PATENT DOCUMENTS

| | | | |
|---|---|---|---|
| CN | 202998413 | U | 6/2013 |
| CN | 207010924 | U | 2/2018 |
| CN | 207266239 | U | 4/2018 |
| CN | 207505100 | U | 6/2018 |
| JP | 58-52785 | A | 3/1983 |

(Continued)

OTHER PUBLICATIONS

International Search Report and Written Opinion of PCT Application No. PCT/JP2019/040509, dated Dec. 24, 2019, 09 pages of ISRWO.

*Primary Examiner* — Amir H Etesam
(74) *Attorney, Agent, or Firm* — Chip Law Group

(57) ABSTRACT

A length of a band part is easily adjusted with the same length regardless of the number of adjustments. There are provided an information output unit that outputs information, a band part whose length is adjustable, and a slide part that is movable with respect to the band part in a length direction of the band part. The slide part is attached with a holding magnet, the band part supports a positioning magnet that attracts the holding magnet in a state where the length of the band part is adjusted, and the positioning magnet is made movable with respect to the band part in a length direction.

15 Claims, 21 Drawing Sheets

(56) References Cited

FOREIGN PATENT DOCUMENTS

| | | | |
|---|---|---|---|
| JP | 2016-082349 | A | 5/2016 |
| KR | 10-2017-0011320 | A | 2/2017 |
| WO | 2017/014350 | A1 | 1/2017 |

* cited by examiner

INFORMATION OUTPUT DEVICE

CROSS REFERENCE TO RELATED APPLICATIONS

This application is a U.S. National Phase of International Patent Application No. PCT/JP2019/040509 filed on Oct. 15, 2019, which claims priority benefit of Japanese Patent Application No. JP 2018-221136 filed in the Japan Patent Office on Nov. 27, 2018. Each of the above-referenced applications is hereby incorporated herein by reference in its entirety.

TECHNICAL FIELD

The present technology relates to a technical field of an information output device having an information output unit configured to output information and a band part whose length is adjustable.

BACKGROUND ART

There are information output devices that are mounted to a body and output information such as audio and video. Examples of the information output devices include, for example, a headphone that is mounted to a head and outputs sound, a shoulder-hanging speaker that is mounted to a shoulder and outputs sound, a head-mounted display that is mounted to a face and outputs images, and the like.

Some of such information output devices are provided with a band part whose length is adjustable, in addition to the information output unit that outputs audio and video (see, for example, Patent Document 1 and Patent Document 2). By adjusting a length of the band part, it becomes possible to mount the band part of a desired length for each user to the head, the shoulder, and the like, and a favorable wearing feeling can be obtained and usability of the information output device can be improved.

In the information output device described in Patent Document 1, a slide part is configured to be movable (slidable) with respect to a band part, a plurality of engaging recesses is formed apart in a length direction of the band part, and a length of the band part is adjustable by engaging a leaf spring with a desired engaging recess while sliding the slide part with respect to the band part.

In the information output device described in Patent Document 2, a plurality of engaging recesses is formed apart in a length direction of the band part, and a length of the band part is adjustable by engaging a rigid ball with a desired engaging recess. The rigid ball is pressed against the engaging recess by the leaf spring, to be engaged.

CITATION LIST

Patent Document

Patent Document 1: Japanese Patent Application Laid-Open No. 2016-82349

Patent Document 2: Japanese examined utility model application publication No. S58-52785

SUMMARY OF THE INVENTION

Problems to be Solved by the Invention

In an information output device in which a length of the band part is adjustable as described above, the length of the band part is often set to a shortest state when not in use. By making the shortest state of the length of the band part, it is easy to store the information output device and it is also convenient to carry the information output device.

Therefore, when the information output device is used, a user often performs adjustment work for adjusting the length of the band part to a desired length from the state where the band part is the shortest. By performing adjustment work on the band part, a favorable wearing feeling can be obtained and usability of the information output device can be improved.

However, in a case of performing the adjustment work on the length of the band part, it is troublesome to visually check an adjustment position each time of the adjustment. Furthermore, in moving the slide part with respect to the band part, performing work while counting engagement position of the leaf spring with respect to the engaging recesses is also troublesome work.

Furthermore, in a case where the user does not know an own proper adjustment position of the band part, if the length of the band part does not fit the body when the length-adjusted band part is mounted to the body, it becomes necessary to adjust the length of the band part again, which may cause inconvenience of repeating the adjustment work until the length of the band part fits the body.

Moreover, in the information output device, for example, in a case where a plurality of slide parts and band parts are provided and a plurality of adjusting parts is included, balance may deteriorate in the wearing condition if adjustment amounts of individual adjusting parts are different, and it may not be possible to obtain favorable wearing feeling.

Therefore, it is an object of an information output device according to the present technology to easily adjust a length of a band part with the same length regardless of the number of adjustments.

Solutions to Problems

First, an information output device according to the present technology includes: an information output unit configured to output information; a band part whose length is adjustable; and a slide part that is movable with respect to the band part in a length direction of the band part. The slide part is attached with a holding magnet, the band part supports a positioning magnet configured to attract the holding magnet in a state where a length of the band part is adjusted, and the positioning magnet is made movable with respect to the band part in a length direction.

This configuration makes it possible to perform positioning of the positioning magnet in advance with respect to the band part in the length direction, and the positioning magnet positioned in advance with respect to the band part attracts the holding magnet by moving the slide part with respect to the band part, to allow the length of the band part to be adjusted.

Second, in the information output device described above, it is desirable that attraction is made in a state where the holding magnet and the positioning magnet are facing each other in a thickness direction.

This configuration makes it possible to increase an attracting area of the holding magnet and the positioning magnet.

Third, in the information output device described above, it is desirable that the band part is provided with a guide part configured to guide the positioning magnet at a time of movement.

This configuration causes the positioning magnet to be guided by the guide part and moved in the length direction of the band part.

Fourth, in the information output device described above, it is desirable that the band part is formed with an arrangement space in which at least a part of the positioning magnet is arranged, and the band part is formed with an opening that communicates with the arrangement space and enables an operation for the positioning magnet.

This configuration allows the positioning magnet to be operated from outside of the band part through the opening, to move the band part in the length direction.

Fifth, in the information output device described above, It is desirable that the band part is provided with an opening formation surface part formed with the opening, and the opening formation surface part is located on a side in contact with a body in a state where the band part is mounted to the body.

This configuration causes the opening formation surface part to be positioned on a side hidden by the body in a state where the band part is mounted to the body.

Sixth, in the information output device described above, it is desirable that the band part is attached with a shortest position magnet configured to attract the holding magnet in a state where the band part is shortened most.

This configuration causes the holding magnet to be attracted to the shortest position magnet, to hold a state where the band part is shortened most.

Seventh, in the information output device described above, it is desirable that attraction is made in a state where the holding magnet and the shortest position magnet are facing each other in a thickness direction.

This configuration makes it possible to increase an attracting area of the holding magnet and the shortest position magnet.

Eighth, in the information output device described above, it is desirable to provide an urging magnet having a repulsive force against the positioning magnet and configured to press the positioning magnet against the band part.

This configuration causes the positioning magnet to be urged by the repulsive force of the urging magnet and pressed against the band part.

Ninth, in the information output device described above, it is desirable that the positioning magnet and the urging magnet are made integrally movable in a length direction of the band part.

This configuration causes the length of the band part to be adjusted by the holding magnet being attracted to the positioning magnet that has been moved integrally with the urging magnet, and therefore a positional relationship between the positioning magnet and the urging magnet does not change.

Tenth, in the information output device described above, it is desirable that the band part is formed with a lock part configured to lock the positioning magnet, the positioning magnet is made movable in a direction approaching and separating from the urging magnet, the positioning magnet is locked to the lock part by a repulsive force of the urging magnet, and the lock part is unlocked by moving the positioning magnet in a direction approaching the urging magnet.

This configuration causes the positioning magnet to be moved in the direction approaching and separating from the urging magnet, to lock or unlock the lock part.

Eleventh, in the information output device described above, it is desirable that a plurality of the lock parts is formed apart in a length direction of the band part.

This configuration causes the holding magnet to be attracted in a state where the positioning magnet is locked to any lock part.

Twelfth, in the information output device described above, it is desirable that a magnet holder configured to hold the positioning magnet is provided, the lock part is formed as a recess, and the magnet holder is provided with a locked protrusion to be inserted into the lock part.

This configuration causes the locked protrusion of the magnet holder to be inserted into the lock part to lock the positioning magnet.

Thirteenth, in the information output device described above, it is desirable that a holding member configured to hold the urging magnet is provided, the holding member is formed with a support hole, the magnet holder is provided with a supported protrusion to be inserted into the support hole, and the positioning magnet is moved in a direction approaching and separating from the urging magnet by the supported protrusion being guided to the support hole.

This configuration causes the supported protrusion of the magnet holder to be inserted into the support hole of the holding member, and the positioning magnet is moved in the direction approaching and separating from the urging magnet.

Fourteenth, in the information output device described above, it is desirable that a part of the band part is provided as a regulating part configured to regulate movement of the urging magnet in a direction separating from the positioning magnet.

This configuration causes a part of the band part to regulate the movement of the urging magnet having a repulsive force against the positioning magnet, in the direction separating from the positioning magnet. Therefore, there is no need for a dedicated regulating part to regulate the movement of the urging magnet in the direction separating from the positioning magnet.

BRIEF DESCRIPTION OF DRAWINGS

FIG. 6 is an exploded perspective view showing an internal structure and the like.

FIG. 8 is an enlarged cross-sectional view showing an internal structure and the like.

FIG. 11 is an enlarged perspective view showing the positioning unit, the urging unit, and the like.

MODE FOR CARRYING OUT THE INVENTION

Hereinafter, an embodiment for implementing an information output device of the present technology will be described with reference to accompanying drawings.

An embodiment described below is an application of the information output device of the present technology to a headphone. However, the scope of application of the present technology is not limited to headphones, and can be widely applied to various information output devices such as an information output device that is mounted to a body and outputs information such as audio and video, for example, a shoulder-hanging speaker that is mounted to a shoulder and outputs sound, a head-mounted display that is mounted to the head and outputs images, and the like.

Note that the information output device (the headphone) shown below has a pair of earpieces to be mounted to both ears and a band part to be mounted to the head. In the following description, individual directions in a state where the earpieces are mounted to the ears and the band part is mounted to the head are shown as front-rear, upper-lower, left-right directions.

However, the front, rear, upper, lower, left, and right directions shown below are for convenience of description, and implementation of the present technology is not limited to these directions.

<Configuration of Information Output Device>

First, a configuration of an information output device 1 will be described (see FIGS. 1 to 12).

Figure 1:
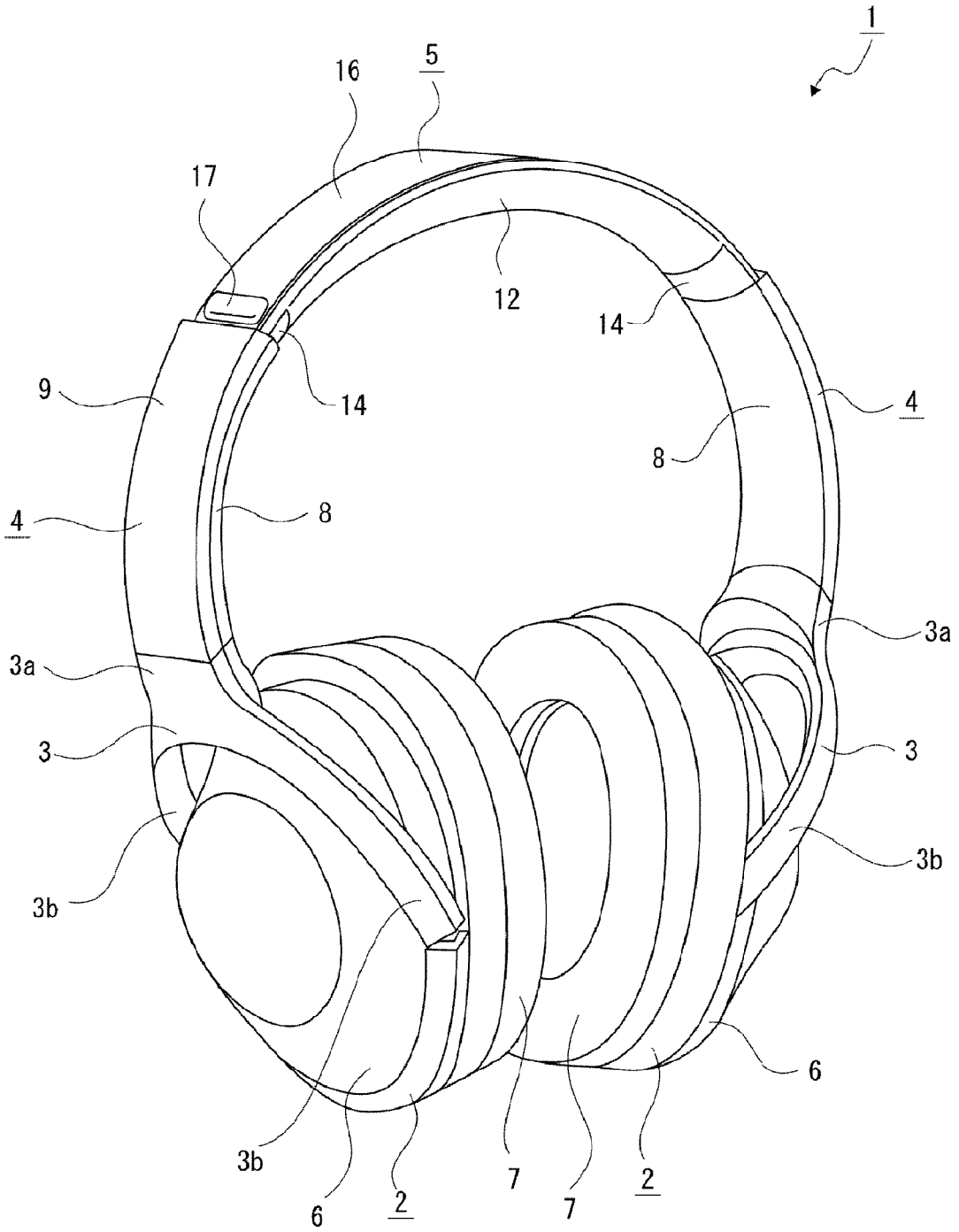
FIG. 1 shows an embodiment of an information output device of the present technology together with FIGS. 2 to 22, and this figure is a perspective view of the information output device.
Figure 2:
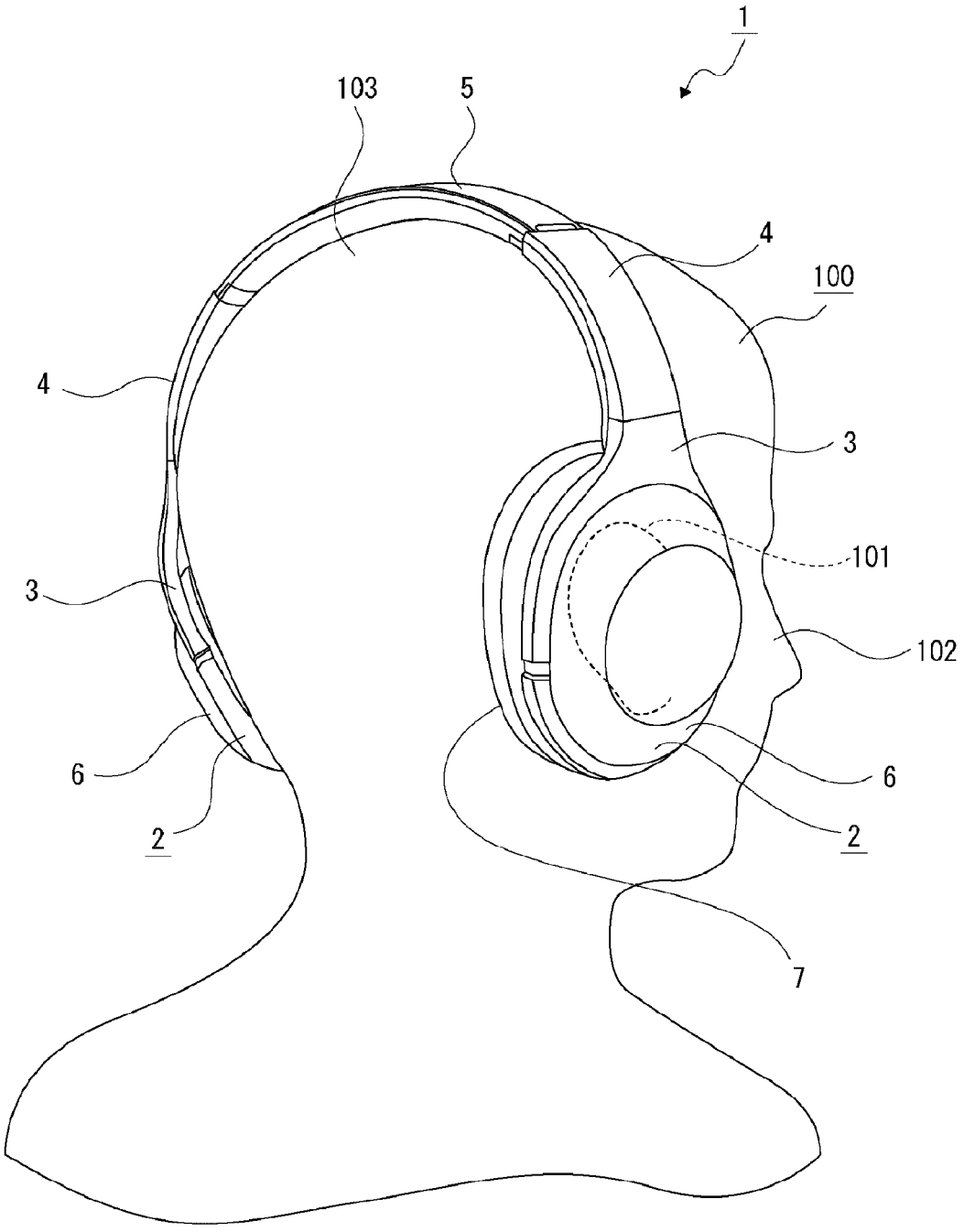
FIG. 2 is a perspective view showing a state where the information output device is mounted.
Figure 3:
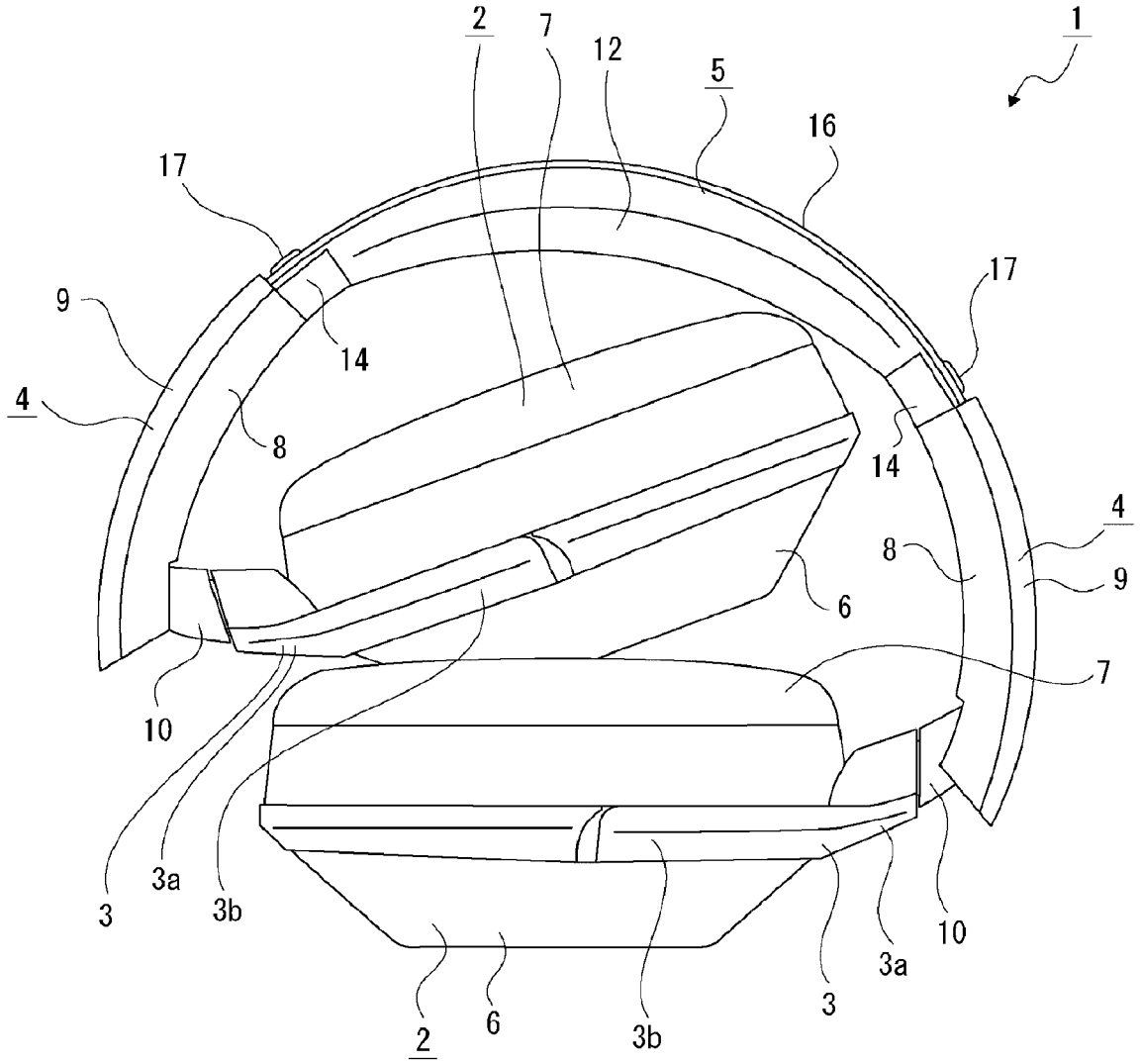
FIG. 3 is a perspective view of the information output device, showing a folded state of an arm.

The information output device 1 has earpieces 2 and 2, arms 3 and 3, slide parts 4 and 4, and a band part 5 (see FIGS. 1 to 3).

The earpieces 2 and 2 are parts to be mounted to a face 102 in a state of covering left and right ears 101 and 101 of a user 100. The earpiece 2 has a housing 6, an ear pad 7, and a speaker unit (not shown).

The housing 6 is formed by, for example, a resin material, and has a space inside. The ear pad 7 is attached to an outer peripheral portion of one surface of the housing 6, and is formed in an annular shape with a flexible cushioning material or the like. The ear pad 7 is placed around the ear 101 on the face 102 in a state of covering the ear 101. The speaker unit is arranged inside the housing 6, and functions as an information output unit that outputs audio information.

Lower end portions of the arms 3 and 3 are connected to the earpieces 2 and 2, respectively.

Note that, in the information output device 1, the earpieces 2 and 2, the arms 3 and 3, and the slide parts 4 and 4 are symmetrically configured, the band part 5 is formed in a symmetrical shape. Further, configurations of individual parts attached to or supported by the earpieces 2 and 2, the arms 3 and 3, the slide parts 4 and 4, and the band part 5, respectively, are also symmetrical. Therefore, one of the left and right configurations of the information output device 1 will be mainly described below.

The arm 3 has a joint part 3*a* located on the slide part 4 side and connecting parts 3*b* and 3*b* branched from the joint part 3*a* in a bifurcated manner.

In the arm 3, lower end portions of the connecting parts 3*b* and 3*b* are connected to the housing 6 of the earpiece 2, in a state pf being rotatable. Therefore, the earpiece 2 is made rotatable with respect to the arm 3. By adjusting the earpiece 2 to an angle according to a size and a shape of the face 102 (see FIGS. 1 and 2) with rotation of the earpiece 2 with respect to the arm 3, it is possible to ensure a favorable wearing condition of the earpiece 2 on the ear 101.

Figure 4:
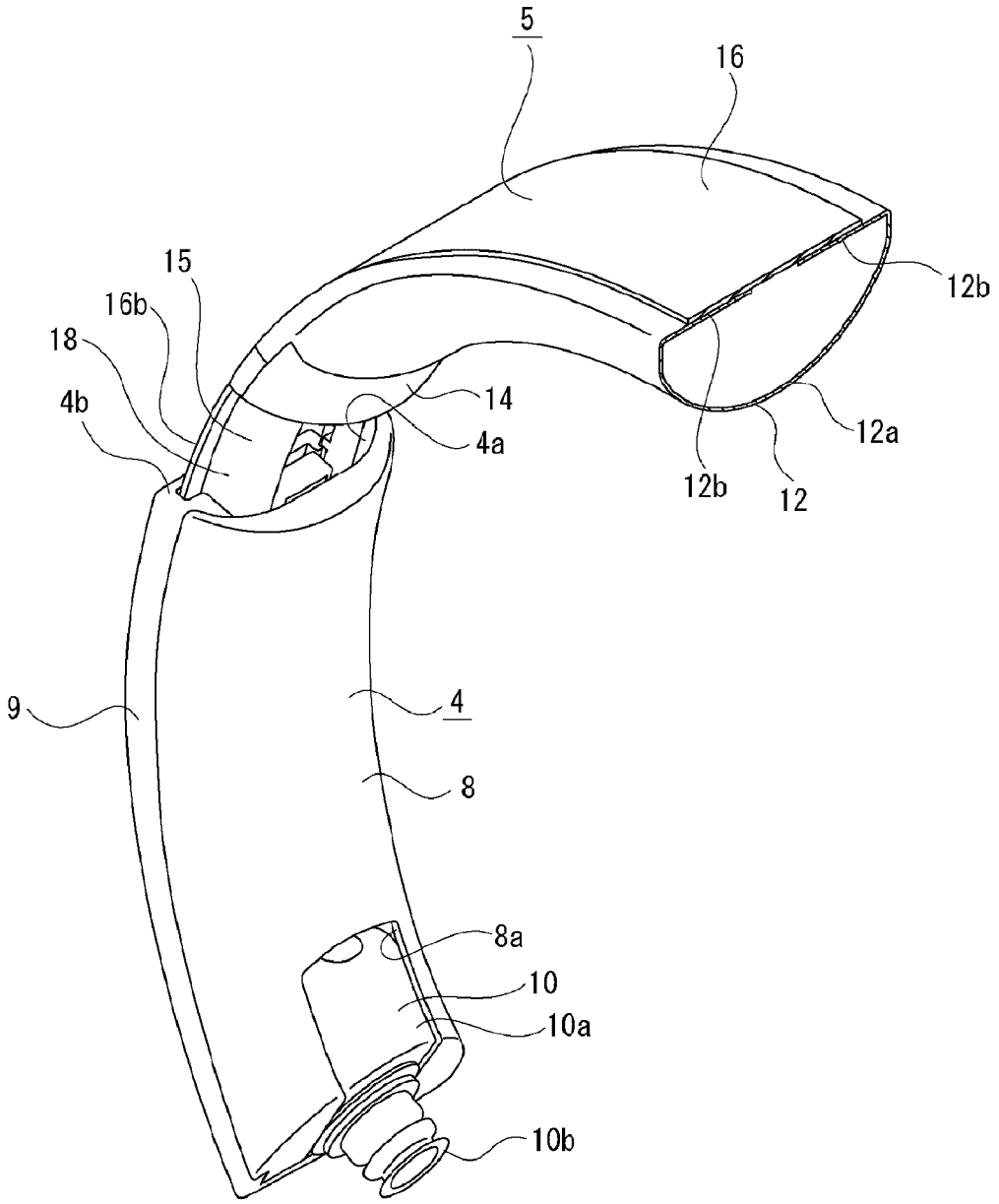
FIG. 4 is a perspective view showing a state where a slide part is slid with respect to a band part.
Figure 5:
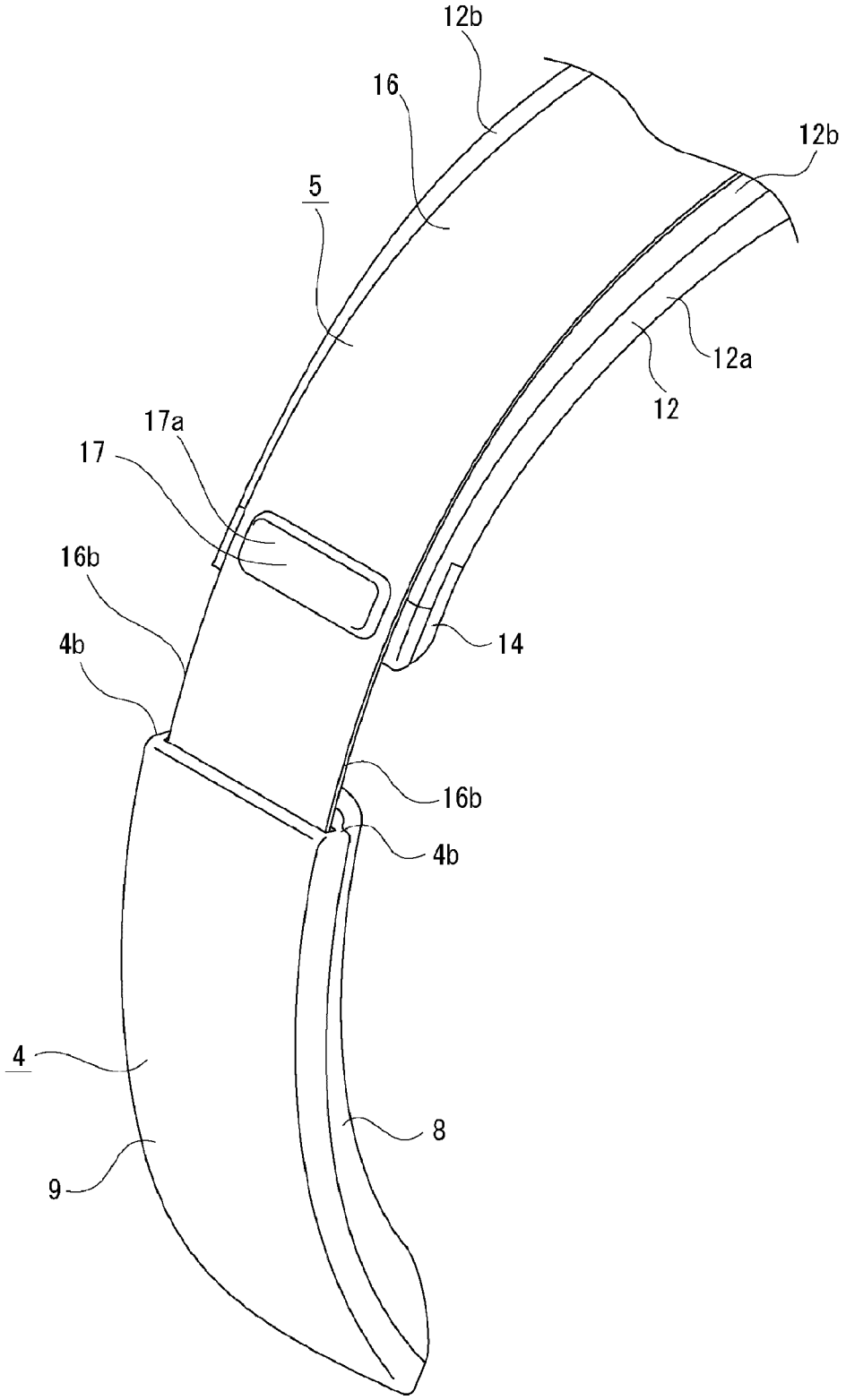
FIG. 5 is a perspective view showing a state where the slide part is slid with respect to the band part in a state of being viewed from a direction different from that in FIG. 4.

The slide part 4 is formed in a substantially arc shape, and extends in substantially the up-down direction (see FIGS. 4 and 5). The slide part 4 has an inner case part 8 and an outer case part 9, which are joined inside and outside. The inner case part 8 is formed in a shape that is opened outward and upward, while the outer case part 9 is formed in a shape that is opened inward and upward (see FIGS. 4 to 7).

Since the slide part 4 is formed in a shape in which the inner case part 8 is opened outward and upward and the outer case part 9 is opened inward and upward, the slide part 4 is formed in a shape having a space 4*a* inside and opened upward. At a lower end portion of the inner case part 8, a support recess 8*a* opened inward and downward is formed.

At both end portions of the slide part 4 in a width direction, guided parts 4*b* and 4*b* are formed. The guided parts 4*b* and 4*b* extend in a longitudinal direction of the slide part 4, and are formed in a recessed shape opened in directions facing each other.

The inner case part 8 rotatably supports a hinge body 10. The hinge body 10 has a supported part 10*a* connected to the inner case part 8 while being inserted in the support recess 8*a*, and a joint protrusion 10*b* projecting from the supported part 10*a*. The joint protrusion 10*b* is joined to the joint part 3*a* of the arm 3.

Therefore, the arm 3 is integrated with the hinge body 10 and is made rotatable with respect to the slide part 4. In this way, since the arms 3 and 3 are rotatable with respect to the slide parts 4 and 4, respectively, for example, the arms 3 and 3 can be stacked in a state of being rotated inward with respect to the slide parts 4 and 4 (see FIG. 3). By stacking the arms 3 and 3 in a state of being rotated inward with respect to the slide parts 4 and 4, the information output device 1 becomes smaller when not in use, and favorable storability and transportability can be ensured.

Figure 7:
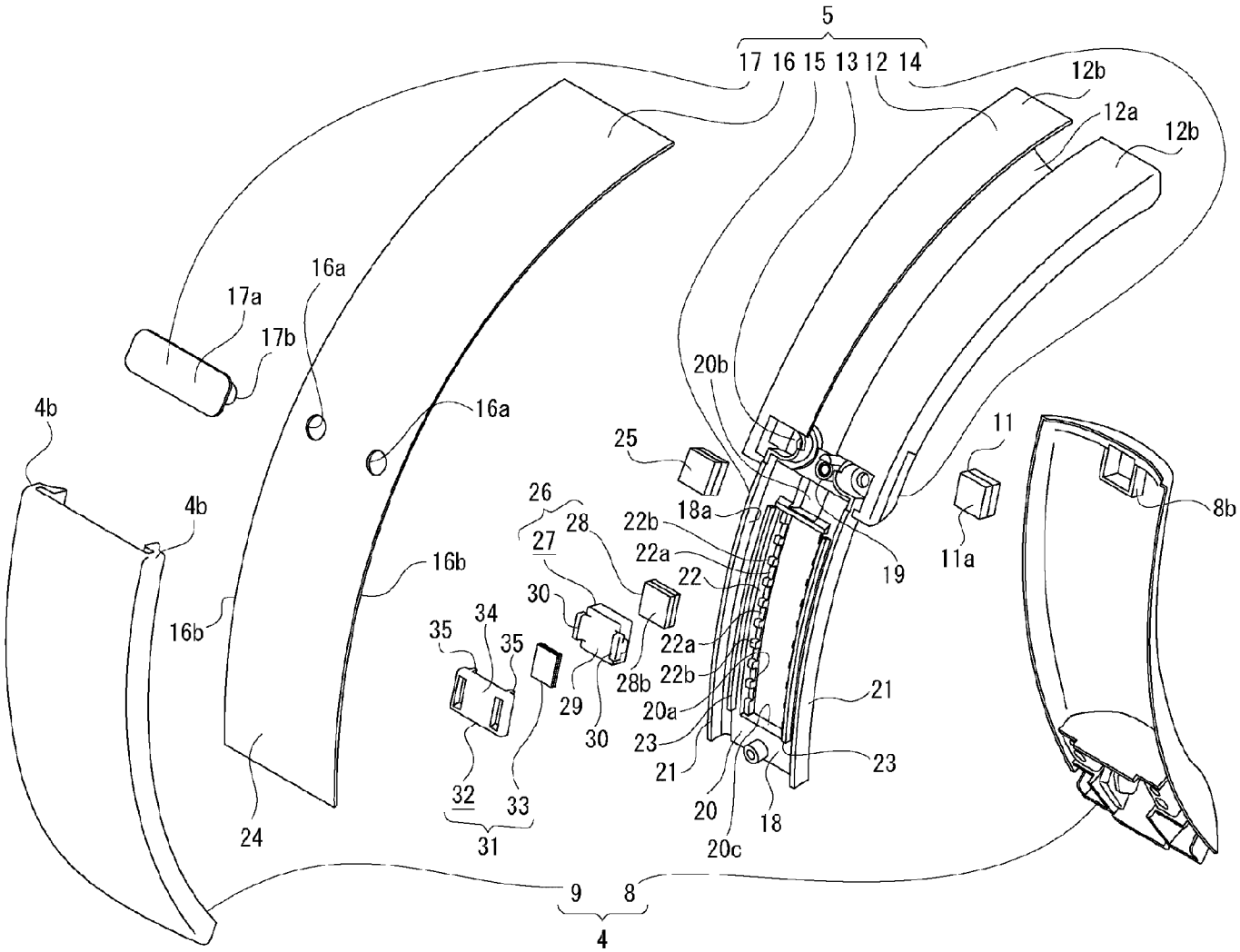
FIG. 7 is an exploded perspective view showing the internal structure and the like in a state of being viewed from a direction different from that in FIG. 6.
Figure 8:
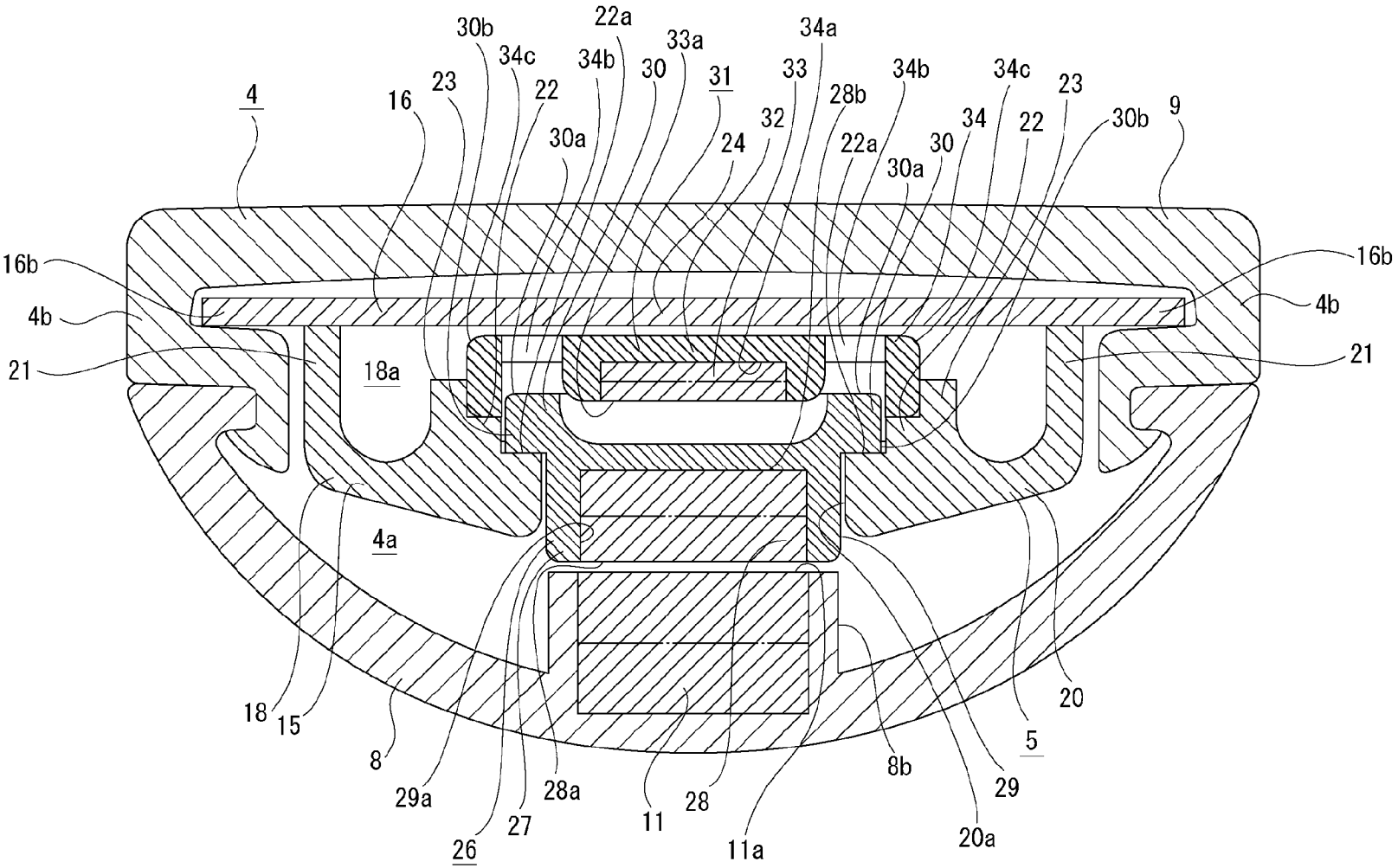
Figure 9:
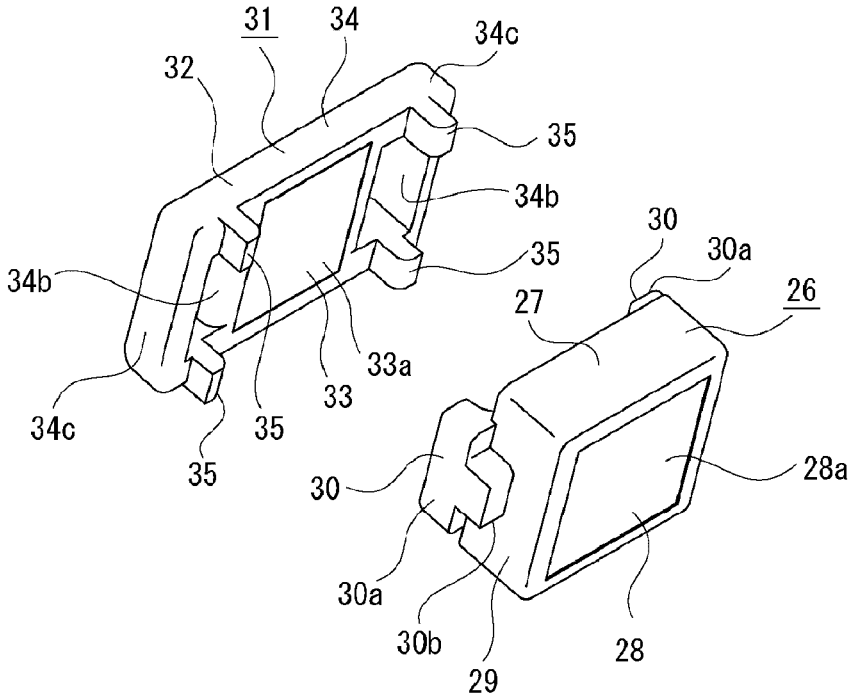
FIG. 9 is an enlarged perspective view showing a positioning unit and an urging unit separately.
Figure 10:
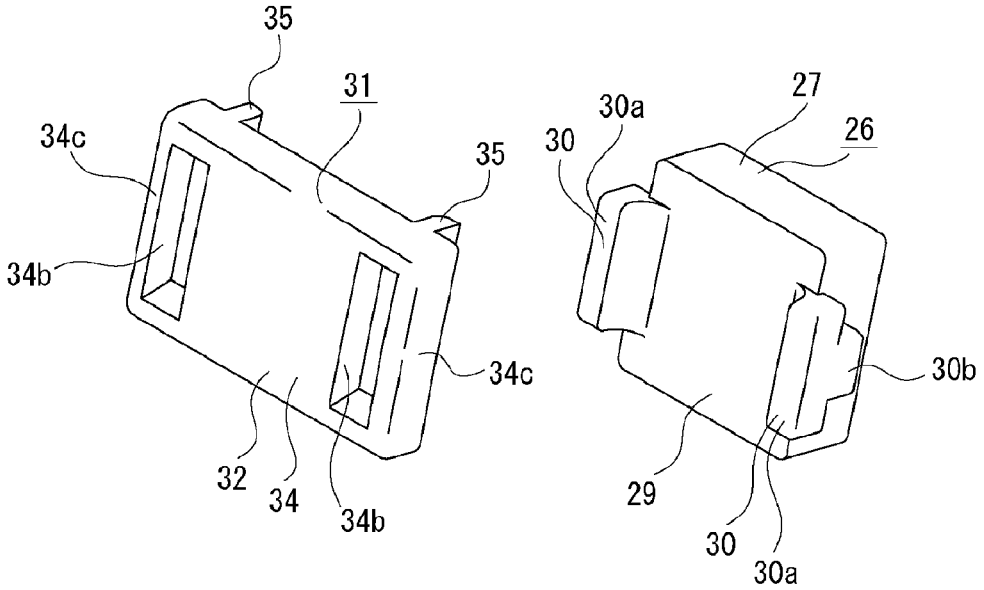
FIG. 10 is an enlarged perspective view showing the positioning unit and the urging unit separately, in a state of being viewed from a direction different from that in FIG. 9.
Figure 11:
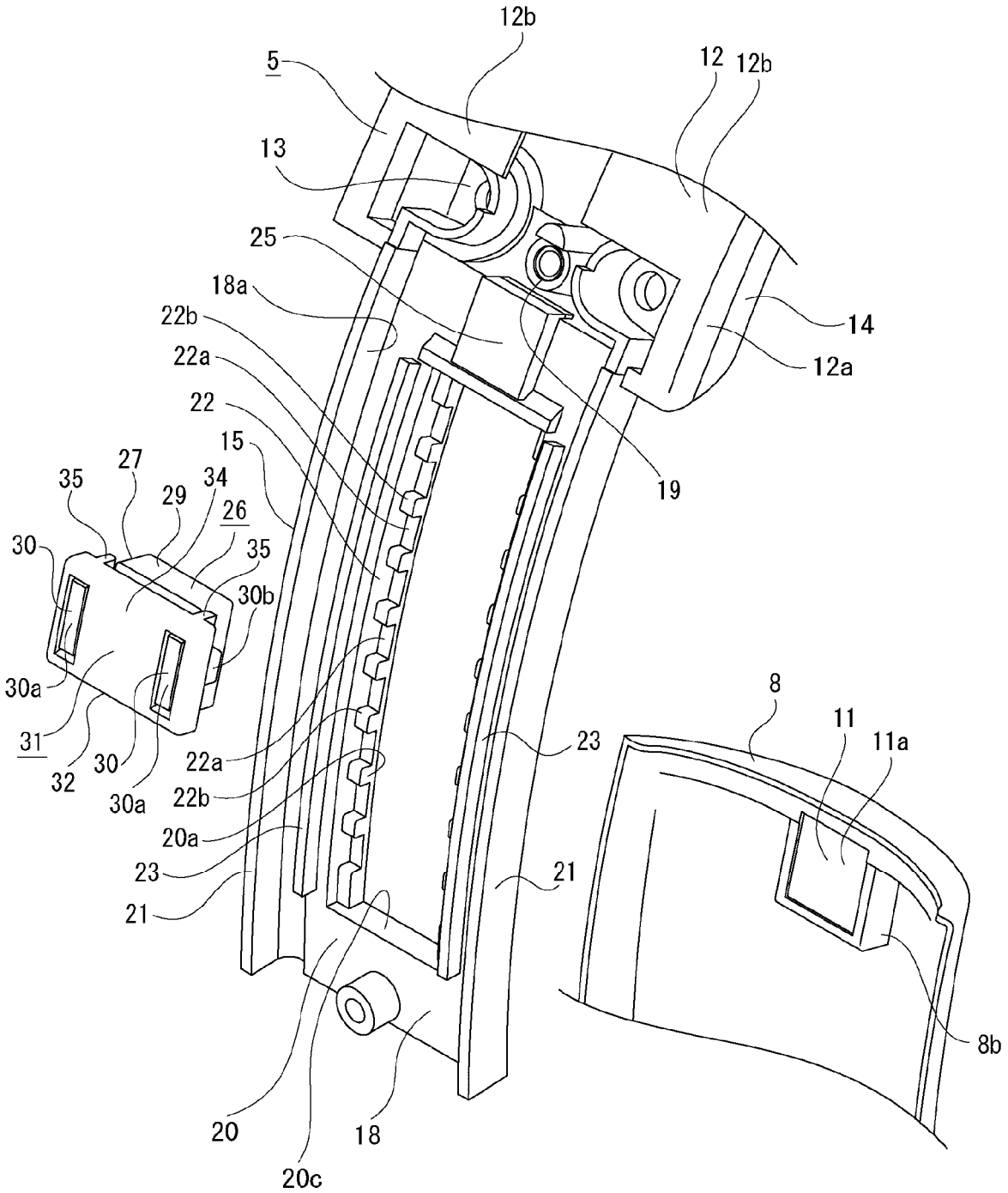

On an inner surface side of an upper end portion of the inner case part 8, a magnet attachment part 8*b* is provided (see FIGS. 7 and 8). The magnet attachment part 8*b* is formed in a recessed shape that is opened outward. To the magnet attachment part 8*b*, a holding magnet 11 is attached in a state of being inserted.

The holding magnet 11 is attached to the magnet attachment part 8*b*, for example, with adhesion or the like, and a thickness direction is made substantially coincident with a joint direction of the inner case part 8 and the outer case part 9 (see FIGS. 6 to 9). The holding magnet 11 is formed in a rectangular parallelepiped shape, for example, and is magnetized at the N and S poles in the thickness direction. As the holding magnet 11, for example, a neodymium magnet is used, and a surface facing the outer case part 9 side in the thickness direction is formed as a facing surface 11*a*.

Note that the holding magnet 11 is not limited to the neodymium magnet, and may be another magnet such as a ferrite magnet, an alnico magnet, or a cobalt magnet. However, neodymium magnets have a characteristic of having a larger magnetic force than other magnets. Therefore, by using a neodymium magnet as the holding magnet 11, the holding magnet 11 can be made compact, and accordingly, the information output device 1 can be made compact and light.

The band part 5 has a main body 12, joint members 13 and 13, a closing plate 14, slide support parts 15 and 15, a cover 16, and fastening members 17 and 17 (see FIGS. 4 and 7).

The main body 12 has an inner portion 12*a* formed in a substantially arc surface shape, and outer surface portions 12*b* and 12*b* projecting from both end portions in a width direction of the inner portion 12*a* in a direction approaching each other. Inside the main body 12, a reinforcing member (not shown) is arranged. The main body 12 is formed in a curved shape so as to be convex outward as a whole.

The joint members 13 and 13 are attached to both end portions of the main body 12 in a longitudinal direction. The closing plate 14 is attached to the joint member 13 from inside, and the closing plate 14 closes the joint member 13 from inside.

The slide support parts 15 and 15 have one end portions in a longitudinal direction joined to the joint members 13 and 13, respectively, and are formed in a curved shape so as to be convex outward as a whole with substantially the same curvature as that of the main body 12. The slide support part 15 has: an adjusting part 18 whose longitudinal direction is the same as the longitudinal direction of the main body 12 and whose outer shape is formed in a substantially rectangular shape; and a joint end portion 19 that is continued to one end in the longitudinal direction of the adjusting part 18. The joint end portion 19 is joined to the joint member 13 by screwing or the like. Therefore, in the slide support part 15, the adjusting part 18 projects from the main body 12 in the longitudinal direction.

The adjusting part 18 has an opening formation surface part 20 and standing wall parts 21 and 21, and the opening formation surface part 20 is formed with a rectangular opening 20*a* extending in a longitudinal direction of the adjusting part 18. The standing wall parts 21 and 21 project outward from both end portions in a width direction of the opening formation surface part 20, respectively. The adjusting part 18 is formed with an arrangement space 18*a* surrounded by the opening formation surface part 20 and the standing wall parts 21 and 21.

At an end portion of the opening formation surface part 20 on the joint end portion 19 side, a magnet attachment part 20*b* is provided. In inner opening edges of the opening formation surface part 20, portions on both side in a width direction are provided as step parts 22 and 22. The step part 22 is formed with a plurality of uneven parts continuous in the longitudinal direction of the adjusting part 18, a recess of the uneven part is formed as a lock part 22*a*, and a projection is provided as a partition wall 22*b*.

The opening formation surface part 20 is provided with guide parts 23 and 23 outside of the step parts 22 and 22 in the width direction, respectively. The guide part 23 is formed in a wall shape that projects outward and extends in the longitudinal direction of the adjusting part 18. The opening formation surface part 20 has surfaces formed with the opening 20*a* and facing each other in the longitudinal direction, and these facing surfaces are formed as regulating surfaces 20*c* and 20*c*.

The cover 16 is a plate-shaped member curved so as to be convex outward, and has a longitudinal direction being coincident with the longitudinal direction of the main body 12 and the slide support part 15. The cover 16 entirely covers the main body 12 and the slide support parts 15 and 15 from outside, and has shaft insertion holes 16*a*, 16*a*, . . . apart in the longitudinal direction. Every two pieces of the shaft insertion holes 16*a*, 16*a*, . . . are located apart in the longitudinal direction of the cover 16. Both end portions of the cover 16 in the seven width directions are provided as guiding parts 16*b* and 16*b*.

The cover 16 is attached to the main body 12 and the slide support parts 15 and 15 by screwing or the like. The cover 16 is provided with portions covering the slide support parts 15 and 15 as regulating parts 24 and 24, respectively.

The fastening members 17 and 17 are attached to both end portions of the main body 12 from outside via the cover 16. The fastening member 17 includes a flat plate-shaped closing part 17*a*, and shaft parts 17*b* and 17*b* projecting in the same direction from the closing part 17*a*. As for the fastening member 17, the shaft parts 17*b* and 17*b* are inserted into the shaft insertion holes 16*a* and 16*a* of the cover 16 from outside, and the shaft parts 17*b* and 17*b* are screwed and attached to the main body 12.

The closing part 17*a* of the fastening member 17 closes an attachment screw that attaches the cover 16 to the main body 12, while the closing plate 14 closes an attachment screw that attaches the fastening member 17 to the main body 12.

To the magnet attachment part 20*b* of the adjusting part 18, a shortest position magnet 25 is attached. The shortest position magnet 25 is attached to the magnet attachment part 20*b* with adhesion or the like, for example, and a thickness direction is made substantially coincident with a joint direction of the slide support part 15 and the cover 16 (see FIGS. 6 to 9). The shortest position magnet 25 is formed in a rectangular parallelepiped shape, for example, and is magnetized at the N and S poles in the thickness direction. As the shortest position magnet 25, for example, a neodymium magnet is used, and a surface facing a direction opposite to the cover 16 in the thickness direction is formed as a facing surface 25*a*. A portion having the facing surface 25*a* in the shortest position magnet 25 is magnetized to an opposite pole to a portion having the facing surface 11*a* in the holding magnet 11.

Note that the shortest position magnet 25 is not limited to the neodymium magnet, and may be another magnet such as a ferrite magnet, an alnico magnet, or a cobalt magnet.

At least a part of the slide support parts 15 and 15 of the band part 5 configured as described above is inserted into the spaces 4*a* and 4*a* of the slide parts 4 and 4, respectively, and a fall stopper part (not shown) prevents the slide parts 4 and 4 from fall-off. The slide parts 4 and 4 are made movable (slidable) in a longitudinal direction of the slide support parts 15 and 15 by the band part 5 (see FIGS. 4 and 5). In a state where the slide part 4 is movably supported by the band part 5, the guiding parts 16*b* and 16*b* of the cover 16 are inserted into the guided parts 4*b* and 4*b* of the slide part 4, respectively. Further, the slide part 4 is moved in the longitudinal direction with respect to the band part 5 with the guided parts 4*b* and 4*b* being guided by the guiding parts 16*b* and 16*b*.

By moving the slide parts 4 and 4 with respect to the band part 5 in this way, a length of a portion exposed from the slide parts 4 and 4 of the slide support parts 15 and 15 is changed, and the length of the band part 5 is adjusted.

Figure 6:
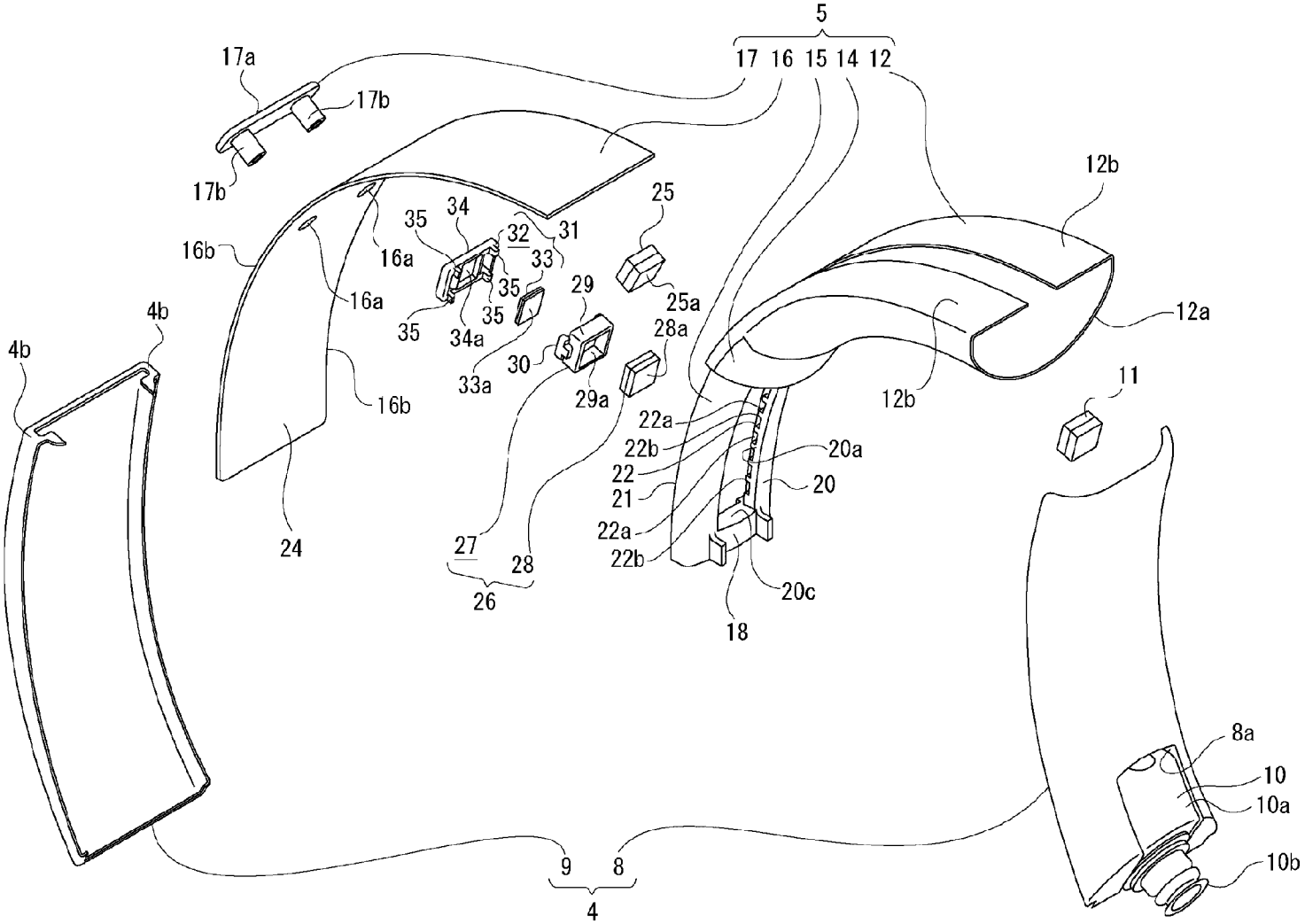
Figure 12:
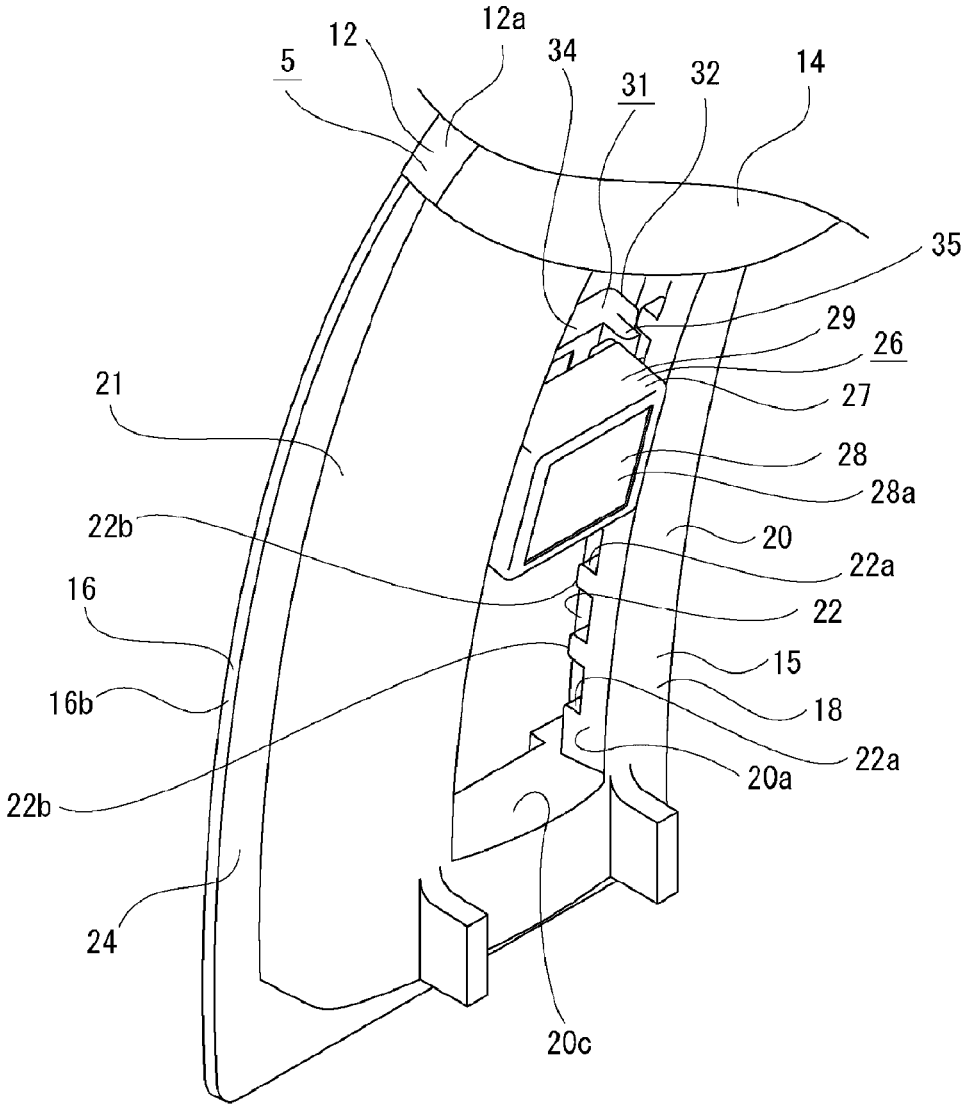
FIG. 12 is a perspective view showing a state where the positioning unit is supported by a slide support part.

The adjusting part 18 supports a positioning unit 26, and the positioning unit 26 is configured by a magnet holder 27 holding a positioning magnet 28 (see FIGS. 6 and 12).

The magnet holder 27 is formed by a resin material, and includes a box-shaped holding part 29 opened on one side and protruding portions 30 and 30 projecting from the holding part 29.

The holding part 29 has a holding recess 29*a* opened on a side opposite to the cover 16. The positioning magnet 28 is attached to and held by the holding part 29 with adhesion or the like, while being inserted into the holding recess 29*a*. The protruding portions 30 and 30 project respectively from both end portions of the holding part 29, and are formed in a symmetrical shape. The protruding portion 30 includes a supported protrusion 30*a* extending in a longitudinal direction of the slide support part 15, and a locked protrusion 30*b* projecting from a central portion of the supported protrusion 30*a* in a longitudinal direction to a side opposite to the cover 16.

The positioning unit 26 is locked to the slide support part 15 by inserting the locked protrusions 30*b* and 30*b* of the magnet holder 27 respectively into the lock parts 22*a* and 22*a* of the step parts 22 and 22 of the opening formation surface part 20, and pressing the supported protrusions 30*a* and 30*a* against the partition walls 22*b*, 22*b*, . . . .

The positioning magnet 28 is attached to the magnet holder 27 while being inserted into the holding recess 29*a*, for example, with adhesion or the like, and a thickness direction is made substantially coincident with the joint direction of the slide support part 15 and the cover 16. The positioning magnet 28 is formed in a rectangular parallelepiped shape, for example, and is magnetized at the N and S poles in the thickness direction. As the positioning magnet 28, for example, a neodymium magnet is used, a surface facing a direction opposite to the cover 16 in the thickness direction is formed as a facing surface 28*a*, and a surface facing the cover 16 side in the thickness direction is formed as an opposite surface 28*b*. In the positioning magnet 28, a portion having the facing surface 28*a* is magnetized to an opposite pole to the portion having the facing surface 11*a* in the holding magnet 11, and a portion having the opposite surface 28*b* is magnetized to an opposite pole to the portion having the facing surface 28*a*.

Note that the positioning magnet 28 is not limited to the neodymium magnet, and may be another magnet such as a ferrite magnet, an alnico magnet, or a cobalt magnet.

The positioning unit 26 is supported by an urging unit 31 so as to be movable in the thickness direction of the positioning magnet 28. The urging unit 31 is configured by a holding member 32 holding an urging magnet 33.

The holding member 32 is formed by a resin material, and includes a flat plate-shaped holding base part 34 and regulating protrusions 35, 35, . . . projecting from the holding base part 34 in a direction opposite to the cover 16. The holding member 32 has a holding recess 34*a* opened on a side opposite to the cover 16. The urging magnet 33 is attached to and held by the holding base part 34 with adhesion or the like, while being inserted into the holding recess 34*a*.

In the holding base part 34, support holes 34*b* and 34*b* are formed apart in an arrangement direction of the protruding portions 30 and 30 of the magnet holder 27. The support holes 34*b* and 34*b* are elongated in a direction orthogonal to the arrangement direction. Both end portions of the holding base 34 in the arrangement direction of the support holes 34*b* and 34*b* are provided as guided parts 34*c* and 34*c*, respectively.

For example, every two pieces of the regulating protrusions 35, 35, . . . are located on both sides of the support holes 34*b* and 34*b* in a longitudinal direction.

In the urging unit 31, the supported protrusions 30*a* and 30*a* of the magnet holder 27 are inserted into the support holes 34*b* and 34*b* of the holding member 32, respectively. By inserting the supported protrusions 30*a* and 30*a* into the support holes 34*b* and 34*b*, the positioning unit 26 is movably supported by the urging unit 31. By moving the positioning unit 26 with respect to the urging unit 31, the positioning magnet 28 is made to approach and separate from the urging magnet 33.

The urging magnet 33 is attached to the holding member 32 while being inserted into the holding recess 34*a*, for example, with adhesion or the like, and a thickness direction is made substantially coincident with the joint direction of the slide support part 15 and the cover 16. The urging magnet 33 is formed in a rectangular parallelepiped shape, for example, and is magnetized at the N and S poles in the thickness direction. As the urging magnet 33, for example, a neodymium magnet is used, and a surface facing a direction opposite to the cover 16 in the thickness direction is formed as a facing surface 33*a*. In the urging magnet 33, a portion having the facing surface 33*a* is magnetized to the same pole as the portion having the opposite surface 28*b* of the positioning magnet 28. Therefore, the urging magnet 33 has a repulsive force against the positioning magnet 28.

Note that the urging magnet 33 is not limited to the neodymium magnet, and may be another magnet such as a ferrite magnet, an alnico magnet, or a cobalt magnet.

The urging magnet 33 is positioned to face the magnet holder 27 in a state where the positioning unit 26 is movably supported by the urging unit 31. Since the urging magnet 33 has the repulsive force against the positioning magnet 28, the positioning unit 26 is urged by the urging unit 31 in a direction separating from the urging unit 31.

Furthermore, the urging unit 31 is urged in a direction separating from the positioning unit 26 by the repulsive force of the urging magnet 33 against the positioning magnet 28, and pressed from a direction opposite to the positioning unit 26 by the regulating part 24 of the cover 16, to be restricted in movement in the direction separating from the positioning unit 26.

In this way, in the information output device 1, on the cover 16 that is a part of the band part 5, there is provided the regulating part 24 configured to regulate movement of the urging magnet 33 in the direction separating from the positioning magnet 28.

Therefore, since a part of the band part 5 regulates the movement of the urging magnet 33 having the repulsive force against the positioning magnet 28 in the direction separating from the positioning magnet 28, there is no need for a dedicated regulating part to regulate the movement of the urging magnet 33 in the direction separating from the positioning magnet 28, and the movement of the urging magnet 33 can be regulated without causing a rise in manufacturing cost.

The urging unit 31 is integrated with the positioning unit 26 and is made movable in the longitudinal direction of the slide support part 15, while the positioning unit 26 is made movable in a direction in which the positioning magnet 28 is approaching and separating from the urging magnet 33 with respect to the urging unit 31.

Note that the positioning unit 26 and the urging unit 31 are made movable in the longitudinal direction of the slide support part 15 in a range where the movement of the positioning unit 26 is regulated by the regulating surfaces 20*c* and 20*c* of the opening formation surface part 20.

<Operation in Information Output Device>

Next, an operation of length adjustment of the band part 5 performed in the information output device 1 will be described (see FIGS. 13 to 22).

Figure 13:
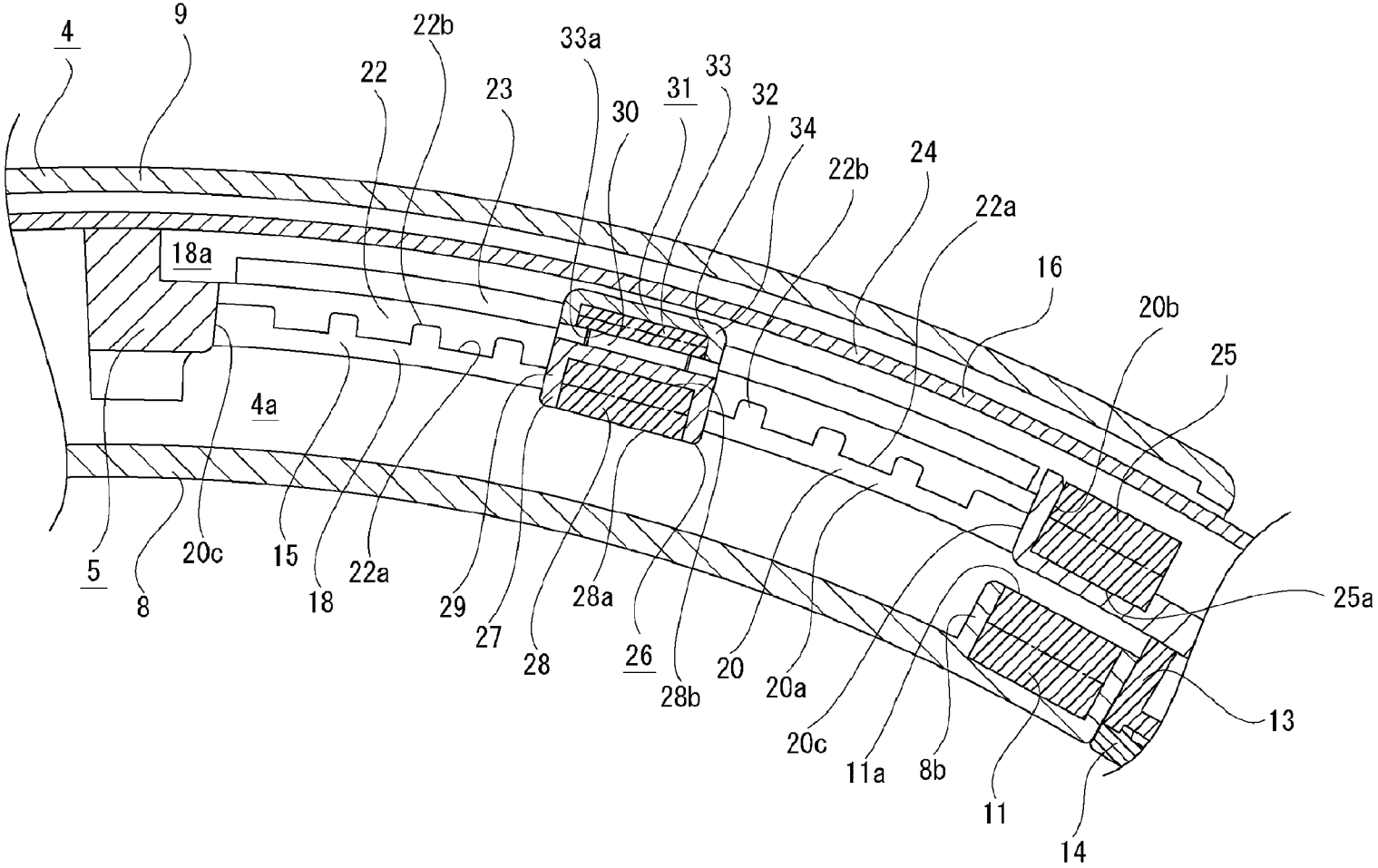
FIG. 13 shows an operation of the information output device together with FIGS. 14 to 22, and this figure is a cross-sectional view showing a state where the band part is shortened most.
Figure 14:
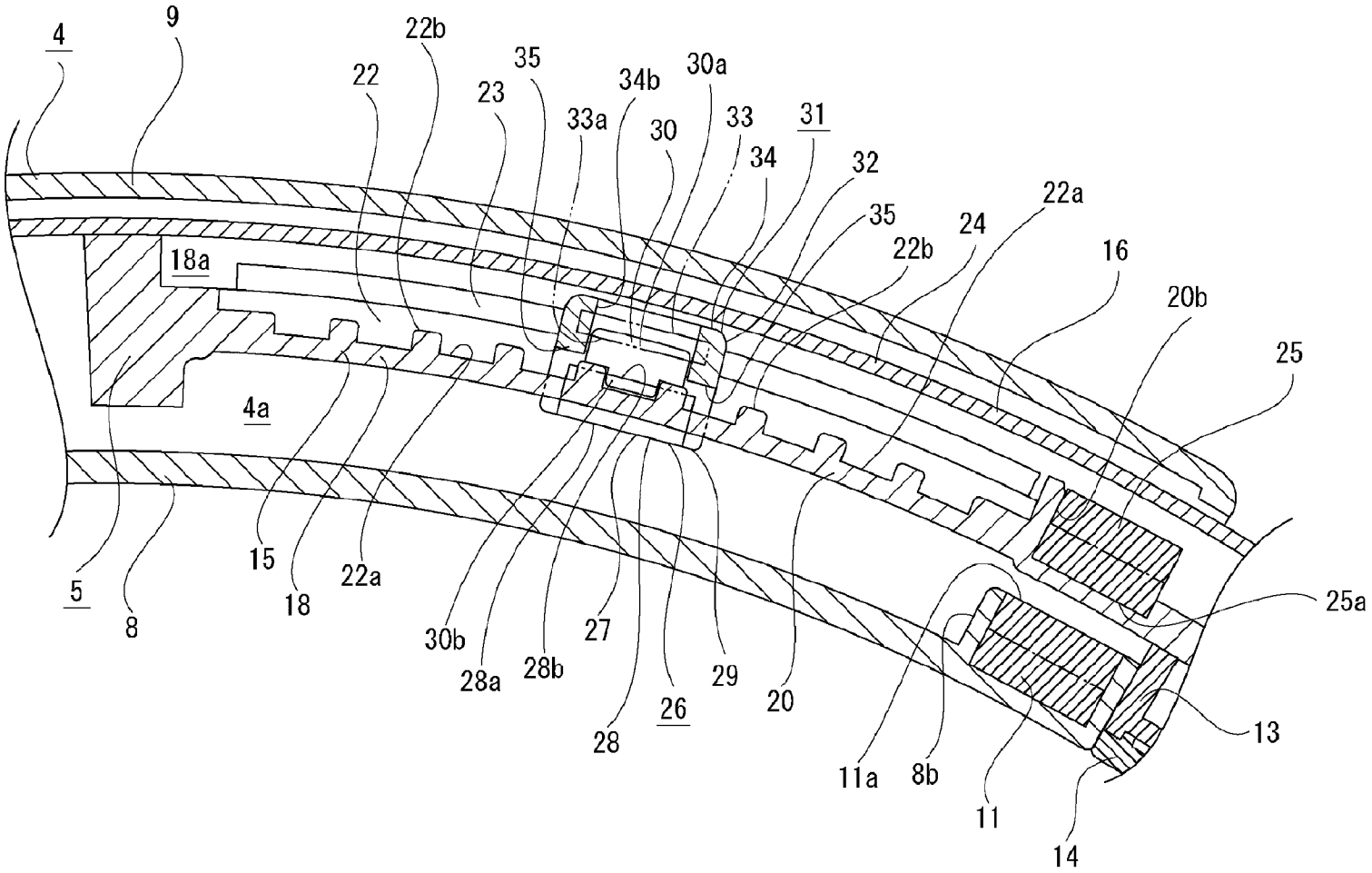
FIG. 14 is a cross-sectional view showing a state where the band part is shortened most in a cross section different from that in FIG. 13.

First, a state where the band part 5 is shortened most in the information output device 1 will be described (see FIGS. 13 and 14).

In a state where the band part 5 is shortened most, the slide parts 4 and 4 are at a shortest position closest to the band part 5. At this time, the facing surface 11*a* of the holding magnet 11 attached to the slide part 4 is positioned to face the facing surface 25*a* of the shortest position magnet 25 attached to the band part 5. Therefore, the holding magnet 11 is attracted to the shortest position magnet 25, and the slide part 4 is held at the shortest position.

In this way, the band part 5 is attached with the shortest position magnet 25 configured to attract the holding magnet 11 in a state where the band part 5 is shortened most.

Therefore, since a state where the band part 5 is shortened most is held by the holding magnet 11 being attracted to the shortest position magnet 25, the band part 5 is not inadvertently extended, and the state where the band part 5 is shortened most can be stably maintained. In particular, since a state where the band part 5 is shortened most is held by the holding magnet 11 being attracted to the shortest position magnet 25, it is possible to carry and store the information output device 1 in a compact state, and it is possible to improve convenience of carrying and storing the information output device 1.

Furthermore, since the attraction is made in a state where the holding magnet 11 and the shortest position magnet 25 are facing each other in the thickness direction, the holding magnet 11 is attracted to the shortest position magnet 25 in a state where the facing surface 11*a* and the facing surface 25*a* facing in the thickness direction are facing each other. Therefore, it is possible to increase an attracting area of the holding magnet 11 and the shortest position magnet 25, and it is possible to stably hold the state where the length of the band part 5 is shortened most.

Next, a positioning operation using the positioning unit 26 and the urging unit 31 will be described (see FIGS. 15 to 20).

Figure 15:
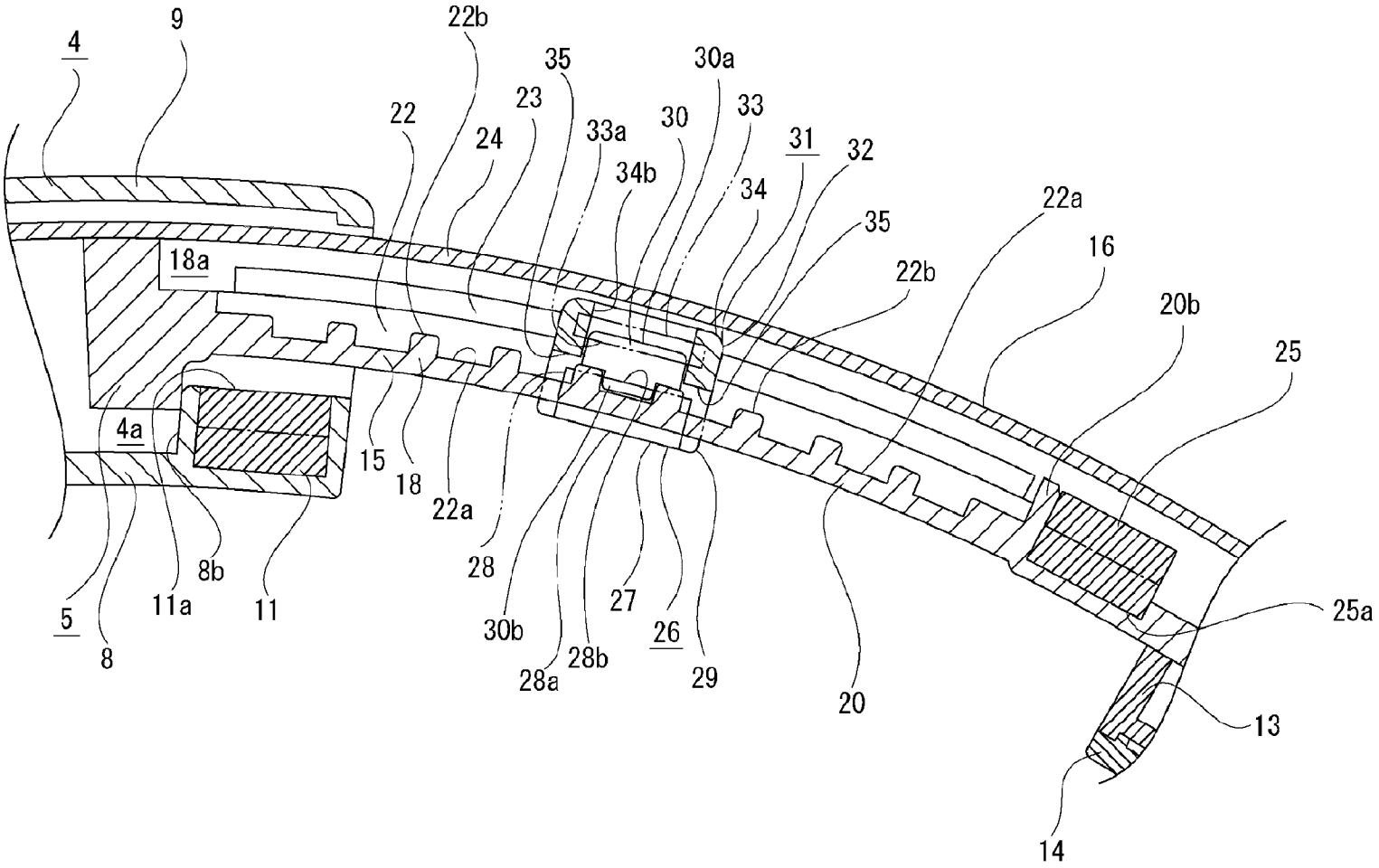
FIG. 15 is a cross-sectional view showing a state where the band part is extended most.
Figure 16:
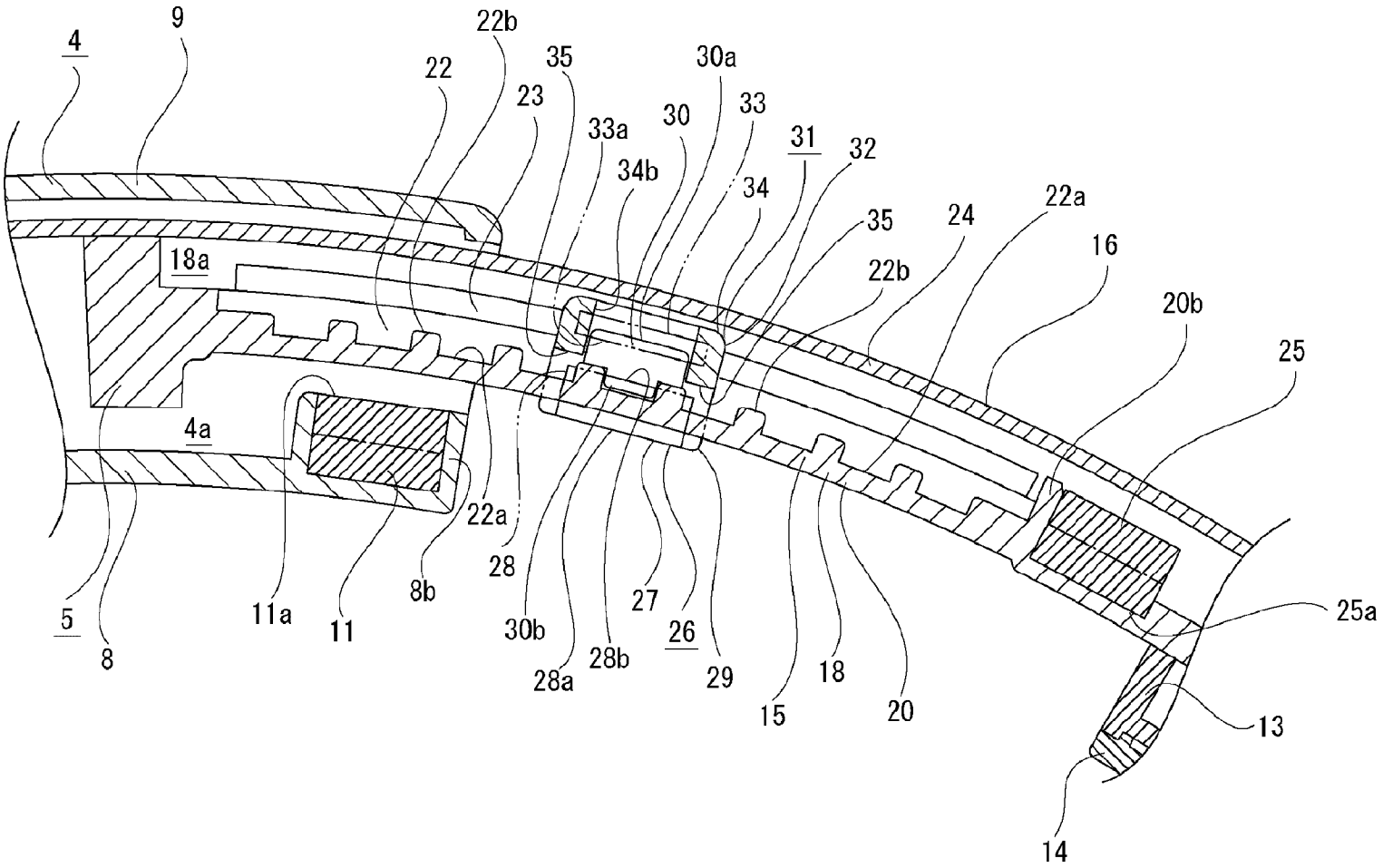
FIG. 16 is a cross-sectional view showing a state where the slide part is slid with respect to the band part, and the positioning unit can be operated.

The positioning operation is performed, first, in a state where the slide part 4 is moved (slid) with respect to the band part 5 to, for example, a longest position where the band part 5 becomes longest, from a state where the band part 5 is shortened most (see FIG. 15). Note that, without moving the slide part 4 to the longest position with respect to the band part 5, the positioning operation can also be performed by moving the slide part 4 to a position where the positioning unit 26 is located between the slide part 4 and the main body 12 and the positioning unit 26 can be operated through the opening 20*a* of the opening formation surface part 20 (see FIG. 16).

The positioning operation can be performed by operating the positioning unit 26 through the opening 20*a* of the opening formation surface part 20. In a state before operating the positioning unit 26, in the positioning unit 26, the locked protrusion 30*b* of the magnet holder 27 is inserted into the lock part 22*a* of the opening formation surface part 20 and locked to the slide support part 15, and the supported protrusion 30*a* is pressed against the partition walls 22*b* and 22*b* by a repulsive force of the urging magnet 33 against the positioning magnet 28 (see FIGS. 15 and 16). At this time, in the urging unit 31, the holding base part 34 of the holding member 32 is pressed against the regulating part 24 of the cover 16 by the repulsive force of the urging magnet 33 against the positioning magnet 28.

Figure 17:
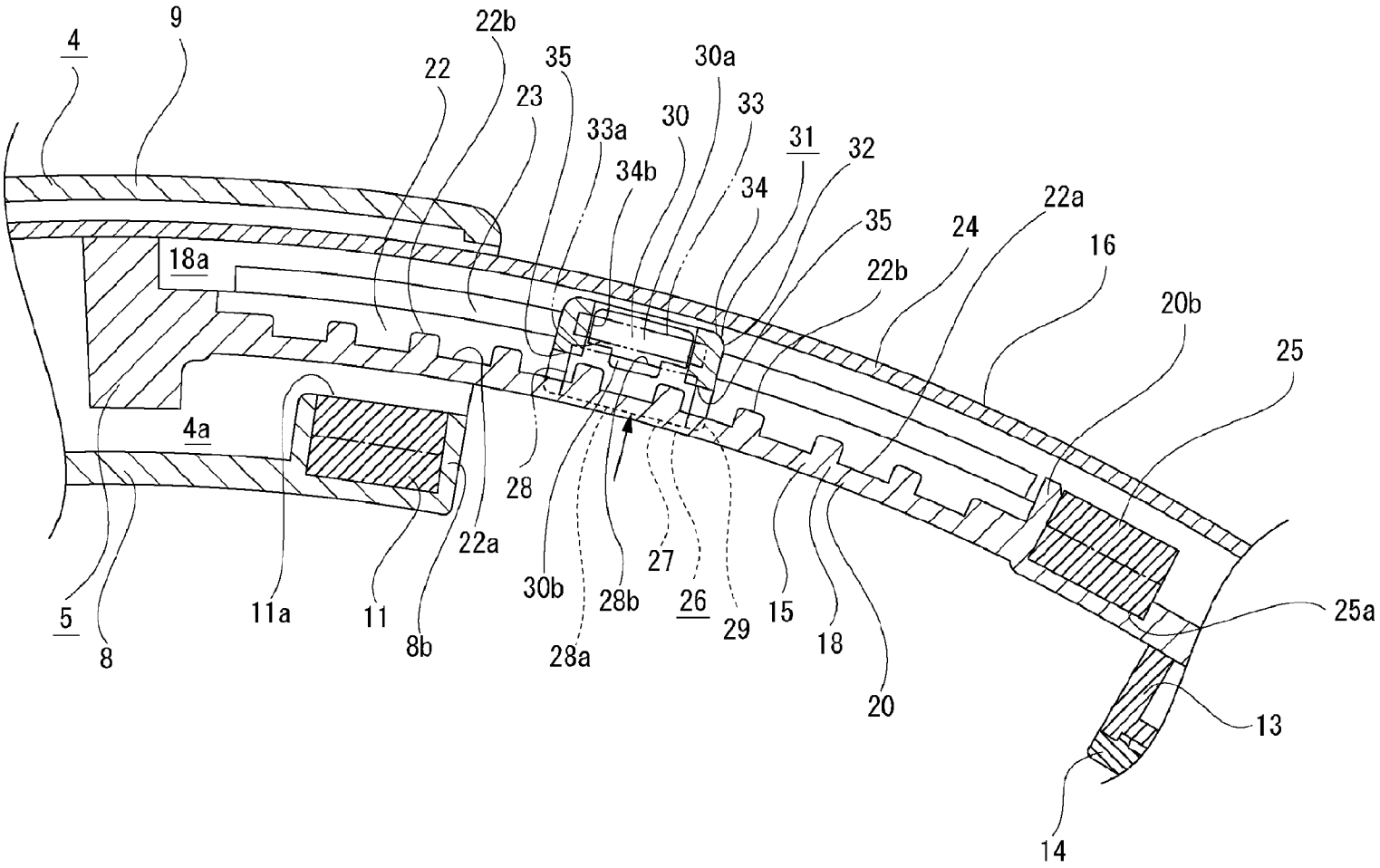
FIG. 17 is a cross-sectional view showing a state where the positioning unit is operated and the slide support part is unlocked.

In the positioning operation, first, the positioning unit 26 is pressed toward the urging unit 31 side, against the repulsive force of the urging magnet 33 against the positioning magnet 28 (see FIG. 17). By pressing the positioning unit 26 toward the urging unit 31 side, the positioning unit 26 is moved to the urging unit 31 side, the locked protrusion 30*b* is pulled out from the lock part 22*a*, and the locked state of the positioning unit 26 on the slide support part 15 is released. At this time, the supported protrusions 30*a* and 30*a* inserted into the support holes 34*b* and 34*b* of the urging unit 31 are separated from the partition walls 22*b*, 22*b*, . . . to the cover 16 side.

When the positioning unit 26 is moved to the urging unit 31 side, the holding part 29 of the magnet holder 27 in the positioning unit 26 is in contact with the regulating protrusions 35, 35, . . . of the holding member 32 in the urging unit 31, and excessive movement of the positioning unit 26 to the urging unit 31 side is regulated by the regulating protrusions 35, 35, . . . . Further, inclination of the positioning unit 26 with respect to the urging unit 31 is suppressed, and orientation of the positioning unit 26 is maintained.

Figure 18:
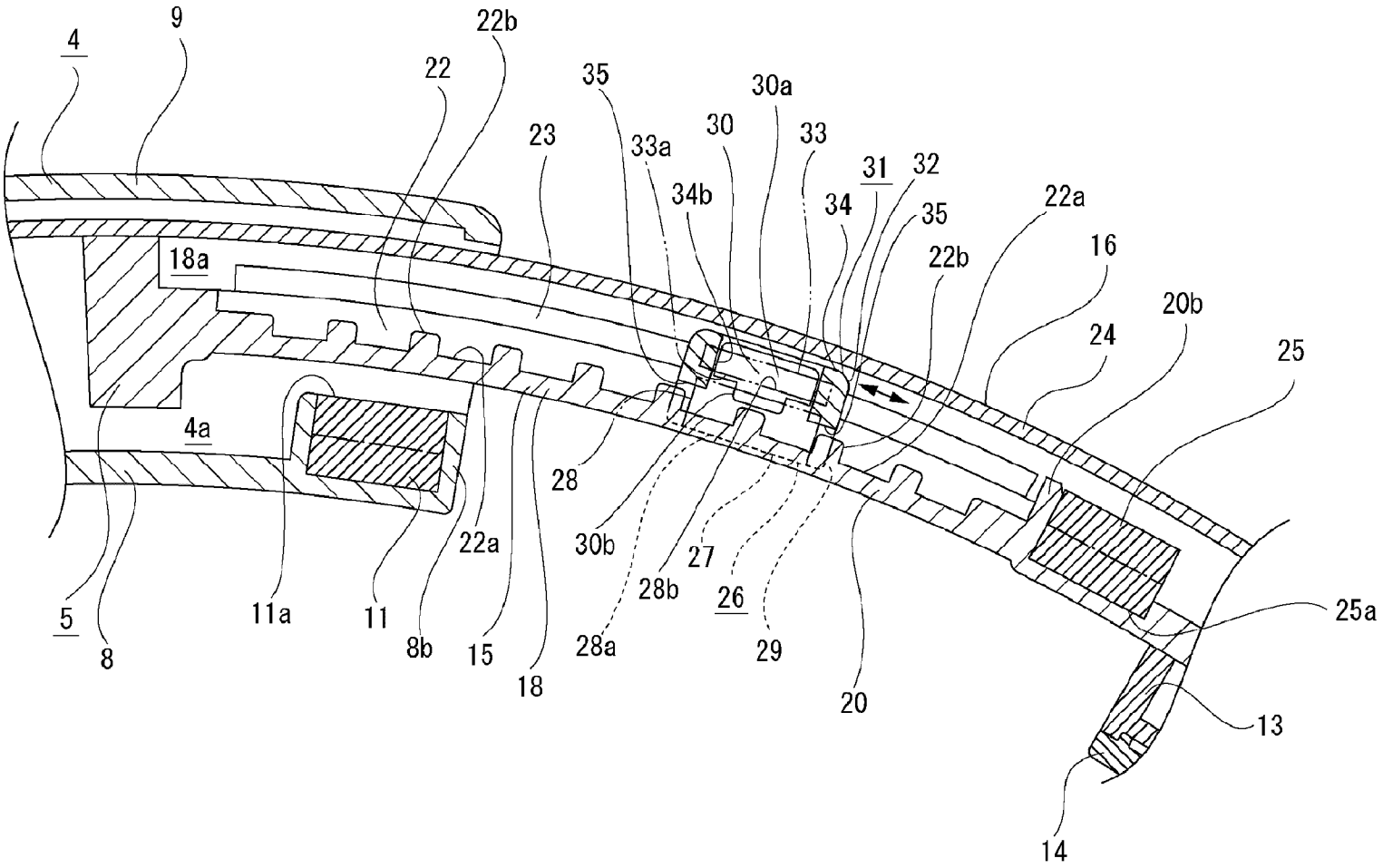
FIG. 18 is a cross-sectional view showing a state where the positioning unit is being moved in a state where the slide support part of the positioning unit is unlocked.

Next, in a state where the positioning unit 26 is pressed toward the urging unit 31 side, the positioning unit 26 is moved with respect to slide support part 15 in a longitudinal direction of the adjusting part 18, toward a desired position for adjusting a length of the band part 5 (see FIG. 18). At this time, since the supported protrusions 30*a* and 30*a* of the positioning unit 26 are inserted into the support holes 34*b* and 34*b* of the urging unit 31, the positioning unit 26 and the urging unit 31 are integrally moved in the longitudinal direction of the adjusting part 18.

Figure 19:
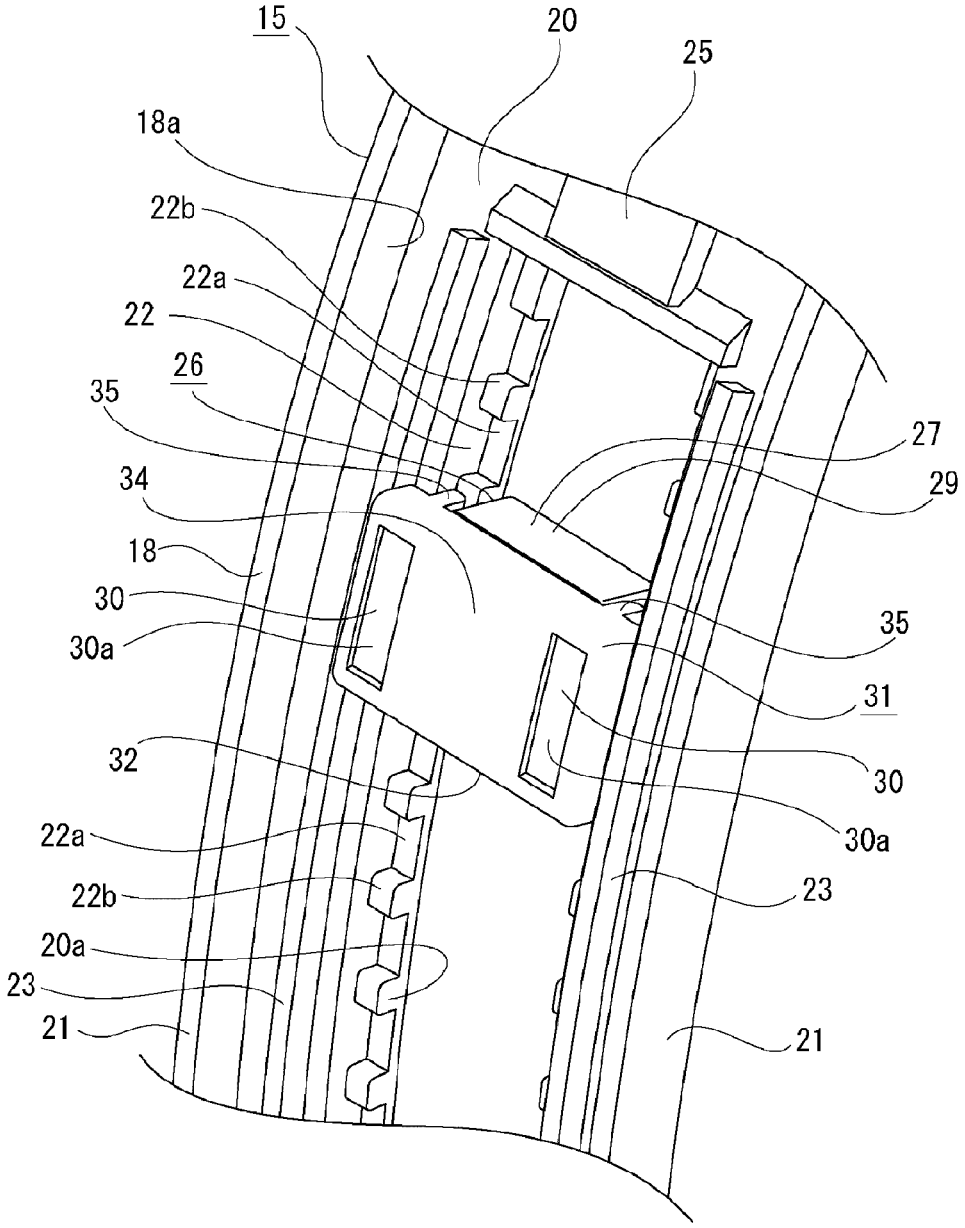
FIG. 19 is a perspective view showing a state where the positioning unit is being moved in a state where the slide support part of the positioning unit is unlocked.

When the positioning unit 26 and the urging unit 31 are moved with respect to the slide support part 15 in the longitudinal direction of the adjusting part 18, the guided parts 34*c* and 34*c* of the holding member 32 are guided and moved by the guide parts 23 and 23 of the adjusting part 18 (see FIG. 19).

In this way, since the band part 5 is provided with the positioning magnet 28 and the guide parts 23 and 23 that guide the urging magnet 33 at a time of movement, the positioning magnet 28 and the urging magnet 33 are guided by the guide parts 23 and 23 and moved in a length direction of the band part 5, and the positioning magnet 28 and the urging magnet 33 can be smoothly and reliably moved in the length direction of the band part 5, to improve the reliability of operation.

Figure 20:
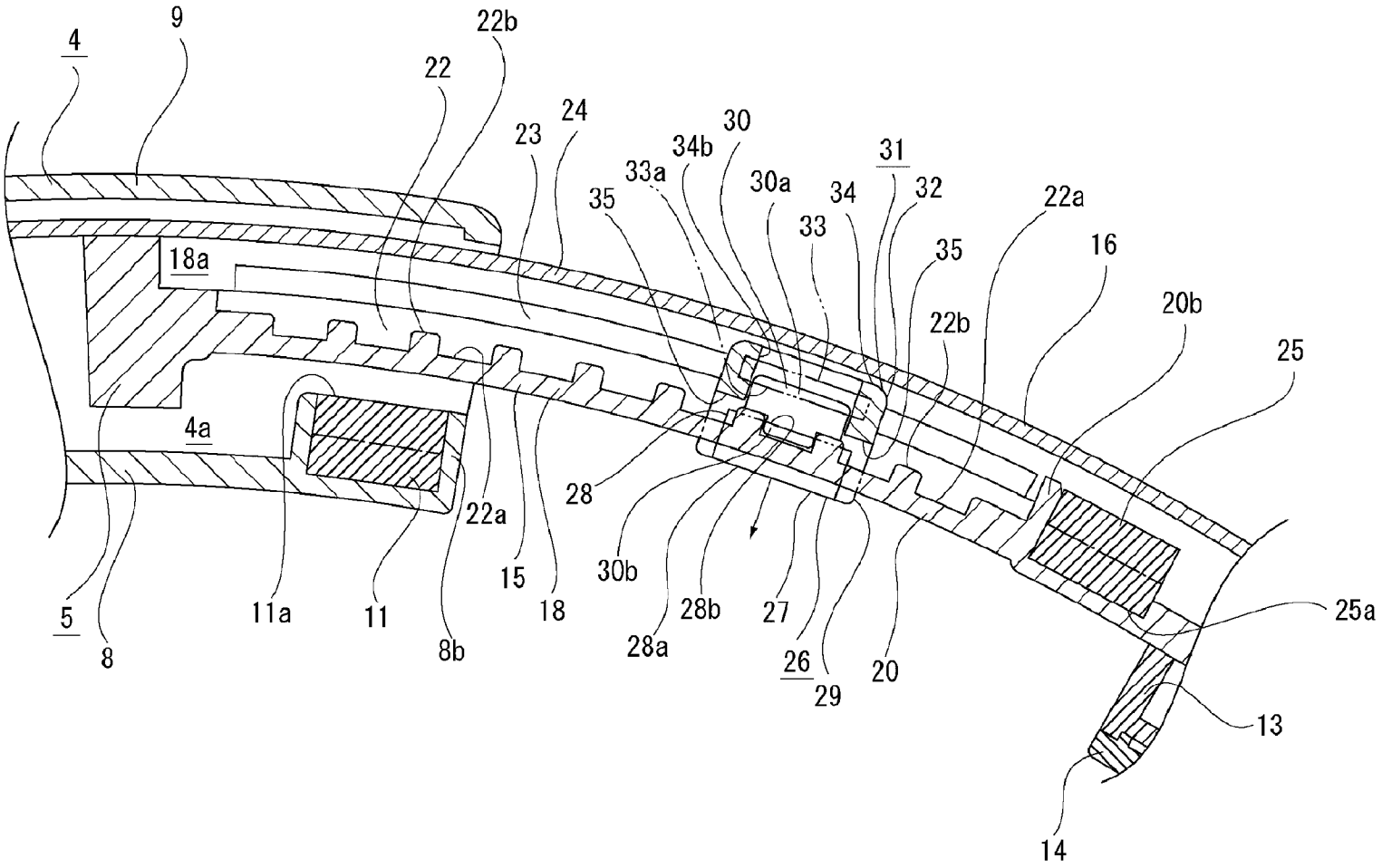
FIG. 20 is a cross-sectional view showing a state where an operation on the positioning unit is released and a positioning operation is completed.

Next, in a state where the positioning unit 26 is moved to a desired position where the length of the band part 5 is desired to be adjusted, pressing of the positioning unit 26 toward the urging unit 31 side is released (see FIG. 20). When the pressing of the positioning unit 26 toward the urging unit 31 side is released, the positioning unit 26 is moved in a direction separating from the urging unit 31 by the repulsive force of the urging magnet 33 against the positioning magnet 28. Then, the locked protrusion 30*b* is inserted again into the lock part 22*a* of the opening formation surface part 20 and locked to the slide support part 15, and the supported protrusion 30*a* is pressed against the partition walls 22*b* and 22*b*.

As described above, by moving the positioning unit 26 to the desired position where the length of the band part 5 is desired to be adjusted, and locking to the slide support part 15, positioning using the positioning unit 26 and the urging unit 31 is completed.

Figure 21:
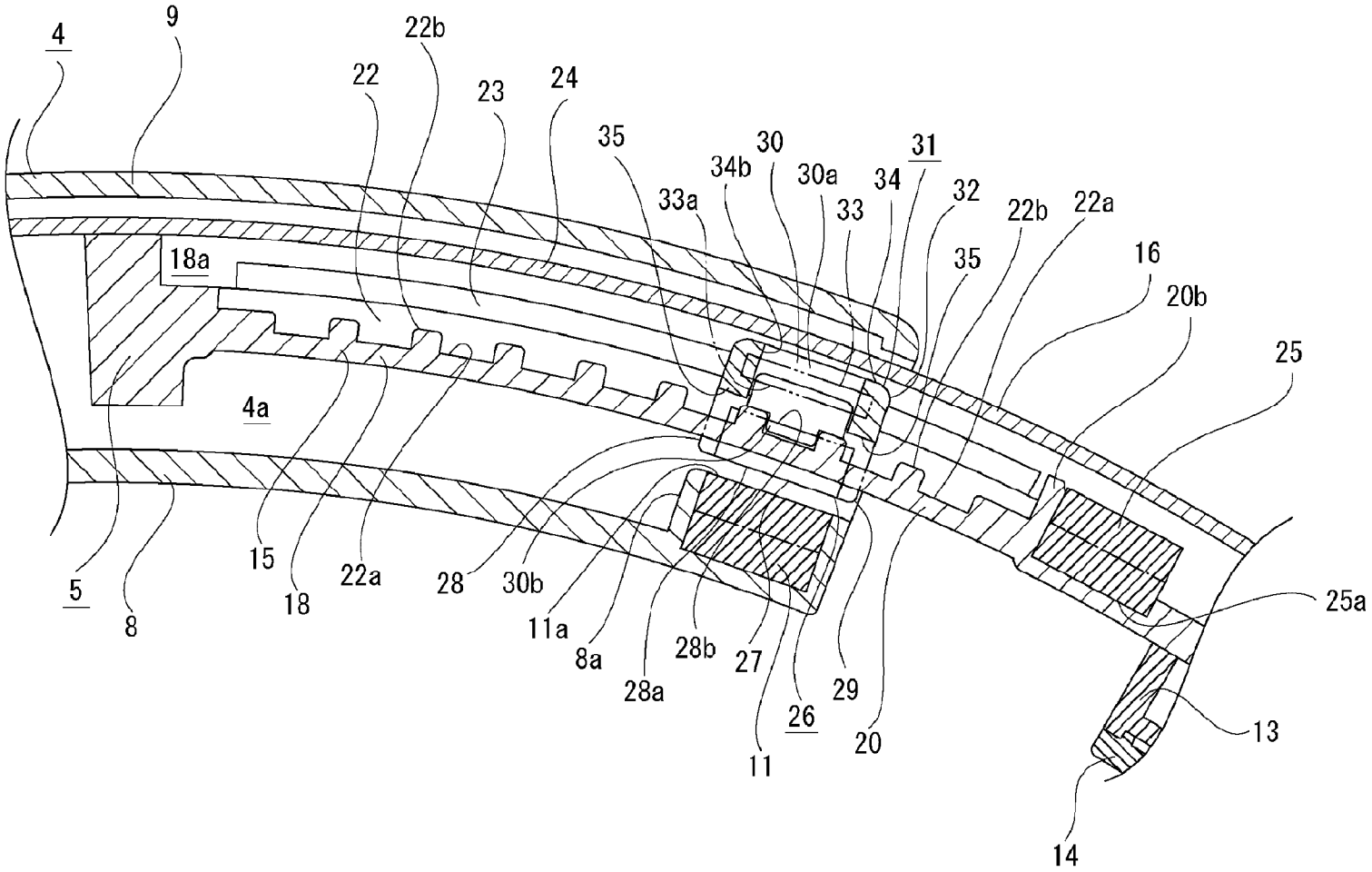
FIG. 21 is a cross-sectional view showing a state where the slide part is slid with respect to the band part, and a length of the band part is adjusted in a state where the positioning operation is completed.

When the positioning is completed, the slide part 4 is moved with respect to the band part 5 (see FIG. 21). By moving the slide part 4 with respect to the band part 5, the holding magnet 11 attached to the slide part 4 is attached to the band part 5 and is attracted to the positioning magnet 28 of the positioning unit 26 completed of positioning, and the slide part 4 is held at a desired position positioned in advance, to adjust the length of the band part 5.

At this time, since the attraction is made in a state where the holding magnet 11 and the positioning magnet 28 are facing each other in the thickness direction, the holding magnet 11 is attracted to the positioning magnet 28 in a state where the facing surface 11*a* and the facing surface 28*a* facing in the thickness direction are facing each other. Therefore, it is possible to increase an attracting area of the holding magnet 11 and the positioning magnet 28, and it is possible to stably hold the state where the length of the band part 5 is adjusted.

Figure 22:
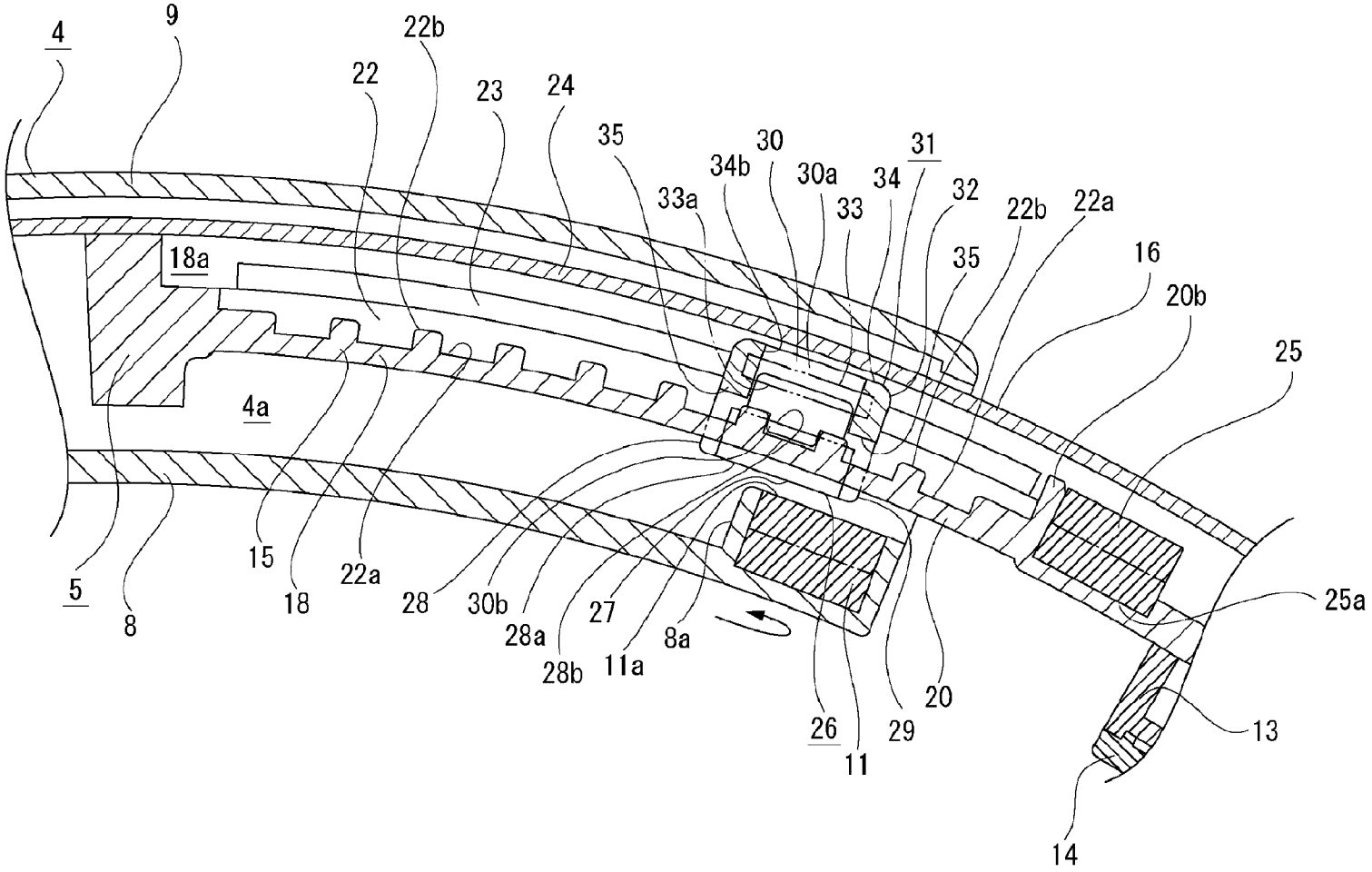
FIG. 22 is a cross-sectional view showing a state where the slide part is slid with respect to the band part to a position where a holding magnet is displaced with respect to a positioning magnet.

Furthermore, when the slide part 4 is moved with respect to the band part 5 during adjustment of the length of the band part 5 described above, the holding magnet 11 may be moved to a position slightly shifted from the positioning magnet 28 with respect to a state where the facing surface 11*a* and the facing surface 28*a* are facing each other (see FIG. 22). In this case, by releasing a hand from the slide part 4, the slide part 4 is moved with respect to the band part 5 due to an attractive force of the positioning magnet 28 for the holding magnet 11, to cause a state where the facing surface 11*a* and the facing surface 28*a* are facing each other.

Therefore, by moving the slide part 4 to an approximate position where the length of the band part 5 is desired to be adjusted, the length of the band part 5 is automatically adjusted by the attractive force of the positioning magnet 28 for the holding magnet 11, and the length of the band part 5 can be adjusted quickly and accurately.

In particular, since the length of the band part 5 is adjusted by the holding magnet 11 being attracted to the positioning magnet 28 whose position has been adjusted in advance with respect to the band part 5, the holding magnet 11 is attracted to the positioning magnet 28 to adjust the band part 5 to the same length each time of the adjustment, and the band part 5 can be easily adjusted with the same length regardless of the number of adjustments.

As described above, in the information output device 1, there is provided the urging magnet 33 having a repulsive force against the positioning magnet 28 and configured to press the positioning magnet 28 against the band part 5. Therefore, since the positioning magnet 28 is urged by the repulsive force of the urging magnet 33 and pressed against the band part 5, the positioning magnet 28 can be easily held at a required position on the band part 5 by a simple configuration.

Furthermore, the positioning magnet 28 and the urging magnet 33 are made integrally movable in the length direction of the band part 5. Therefore, since the length of the band part 5 is adjusted by the holding magnet 11 being attracted to the positioning magnet 28 that has been moved integrally with the urging magnet 33, a positional relationship between the positioning magnet 28 and the urging magnet 33 does not change, and a positioning operation can be reliably performed regardless of a moving position of the positioning magnet 28.

Moreover, the lock part 22*a* configured to lock the positioning magnet 28 is formed on the band part 5, the positioning magnet 28 is made movable in the direction approaching and separating from the urging magnet 33, the positioning magnet 28 is locked to the lock part 22*a* by the repulsive force of the urging magnet 33, and the lock part 22*a* is unlocked by moving the positioning magnet 28 in the direction approaching the urging magnet 33.

Therefore, since the lock or unlock on the lock part 22*a* is performed by moving the positioning magnet 28 in the direction approaching and separating from the urging magnet 33, the locked state of the positioning magnet 28 on the lock part 22*a* can be easily changed with a simple configuration.

Furthermore, since a plurality of the lock parts 22*a* is formed apart in the length direction of the band part 5, the positioning magnet 28 is made movable in a length direction of the band part 5, and the plurality of lock parts 22*a* is formed apart in the length direction. Therefore, the positioning magnet 28 attracts the holding magnet 11 while being locked to any one of the lock parts 22*a*, and the positioning magnet 28 can be locked at a desired position to allow the length of the band part 5 to be easily and reliably adjusted.

Furthermore, the magnet holder 27 configured to hold the positioning magnet 28 is provided, the lock part 22*a* is formed as a recess, and the magnet holder 27 is provided with the locked protrusion 30*b* to be inserted into the lock part 22*a*.

Therefore, since the locked protrusion 30*b* of the magnet holder 27 is inserted into the lock part 22*a* to lock the positioning magnet 28, the positioning magnet 28 can be locked to the lock part 22*a* by a simple structure and can be reliably held at a required position in the band part 5.

In addition, the holding member 32 configured to hold the urging magnet 33 is provided, the support hole 34*b* is formed in the holding member 32, the magnet holder 27 is provided with the supported protrusion 30*a* to be inserted into the support hole 34*b*, and the positioning magnet 28 is moved in the direction approaching and separating from the urging magnet 33 by the support hole 34*b* guiding the supported protrusion 30*a*.

Therefore, since the supported protrusion 30*a* of the magnet holder 27 is inserted into the support hole 34*b* of the holding member 32, and the positioning magnet 28 is moved in the direction approaching and separating from the urging magnet 33, the positioning magnet 28 can be reliably moved in the direction approaching and separating from the urging magnet 33 by a simple structure.

<Mounting of Information Output Device>

In the information output device 1 configured as described above, the earpieces 2 and 2 are mounted to the face 102 in a state of covering the left and right ears 101 and 101 of the user 100, and the band part 5 is mounted to a head 103 from above (see FIG. 2). The ears 101 and 101 are covered by the ear pads 7 and 7, respectively, and the ear pads 7 and 7 are placed around the ears 101 and 101 on the face 102, respectively.

In a state where the information output device 1 is mounted to the user 100 in this way, the opening formation surface part 20 of the band part 5 is located on a side in contact with the body (the face). Therefore, since the opening formation surface part 20 is located on a side hidden by the body in a state where the band part 5 is mounted to the face 102, it is possible to suppress intrusion of dust from the opening 20*a* of the opening formation surface part 20.

SUMMARY

As described above, in the information output device 1, the holding magnet 11 is attached to the slide part 4, the band part 5 supports the positioning magnet 28 configured to attract the holding magnet 11 in a state where the length of the band part 5 is adjusted, and the positioning magnet 28 is made movable with respect to the band part 5 in a length direction.

Therefore, it becomes possible to position the positioning magnet 28 with respect to the band part 5 in the length direction in advance. Further, the length of the band part 5 is adjusted by moving the slide part 4 with respect to the band part 5 to cause the holding magnet 11 to be attracted by the positioning magnet 28 that has been positioned in advance with respect to the band part 5, and the length of the band part 5 can be easily adjusted with the same length regardless of the number of adjustments.

In particular, in a case of performing adjustment work on the length of the band part 5, it is not necessary to visually check the adjustment position each time of the adjustment, and the appropriate length adjustment of the band part 5 can be performed quickly and easily.

Furthermore, the arrangement space 18*a* in which at least a part of the positioning magnet 28 is arranged is formed in the band part 5, and the opening 20*a* is formed in the band part 5 so as to communicate with the arrangement space 18*a* and allow a part of the positioning magnet 28 to project.

Therefore, it becomes possible to operate the positioning magnet 28 from outside of the band part 5 through the opening 20*a* to move the band part 5 in the length direction, and it is possible to improve the operability related to the length adjustment of the band part 5.

<Others>

The description above has shown an example in which the positioning unit 26 is urged by using the urging unit 31 having the urging magnet 33, but the urging unit that urges the positioning unit 26 is not limited to the urging unit 31 using the urging magnet 33, and may be an urging unit having means other than a magnet. For example, it is possible to adopt an urging unit that urges the positioning unit 26 with an elastic member such as a spring or rubber.

Furthermore, in the information output device 1, two slide parts 4 and 4 are made movable with respect to the band part 5, a plurality of adjusting parts is provided, and the length of the band part 5 can be adjusted separately by each of these two adjusting parts, to obtain a favorable balance in the wearing condition and obtain a favorable wearing feeling.

However, the number of the slide parts 4 provided in the information output device 1 may be one, or may be three or more.

<The Present Technology>

The present technology can have the following configurations.

(1)

An information output device including:

an information output unit configured to output information;

a band part whose length is adjustable; and a slide part that is movable with respect to the band part in a length direction of the band part, in which the slide part is attached with a holding magnet, the band part supports a positioning magnet configured to attract the holding magnet in a state where a length of the band part is adjusted, and the positioning magnet is made movable with respect to the band part in a length direction.

(2)

The information output device according to (1) above, in which attraction is made in a state where the holding magnet and the positioning magnet are facing each other in a thickness direction.

(3)

The information output device according to (1) or (2) above, in which the band part is provided with a guide part configured to guide the positioning magnet at a time of movement.

(4)

The information output device according to any one of (1) to (3) above, in which the band part is formed with an arrangement space in which at least a part of the positioning magnet is arranged, and the band part is formed with an opening that communicates with the arrangement space and enables an operation for the positioning magnet.

(5)

The information output device according to (4) described above, in which the band part is provided with an opening formation surface part formed with the opening, and the opening formation surface part is located on a side in contact with a body in a state where the band part is mounted to the body.

(6)

The information output device according to any one of (1) to (5) above, in which the band part is attached with a shortest position magnet configured to attract the holding magnet in a state where the band part is shortened most.

(7)

The information output device according to (6) described above, in which attraction is made in a state where the holding magnet and the shortest position magnet are facing each other in a thickness direction.

(8)

The information output device according to any one of (1) to (7) above, in which there is provided an urging magnet having a repulsive force against the positioning magnet and configured to press the positioning magnet against the band part.

(9)

The information output device according to (8) described above, in which the positioning magnet and the urging magnet are made integrally movable in a length direction of the band part.

(10)

The information output device according to (8) or (9), in which the band part is formed with a lock part configured to lock the positioning magnet, the positioning magnet is made movable in a direction approaching and separating from the urging magnet, the positioning magnet is locked to the lock part by a repulsive force of the urging magnet, and the lock part is unlocked by moving the positioning magnet in a direction approaching the urging magnet.

(11)

The information output device according to (10) described above, in which a plurality of the lock parts is formed apart in a length direction of the band part.

(12)

The information output device according to (10) or (11), in which a magnet holder configured to hold the positioning magnet is provided, the lock part is formed as a recess, and the magnet holder is provided with a locked protrusion to be inserted into the lock part.

(13)

The information output device according to (12) described above, in which a holding member configured to hold the urging magnet is provided, the holding member is formed with a support hole, the magnet holder is provided with a supported protrusion to be inserted into the support hole, and the positioning magnet is moved in a direction approaching and separating from the urging magnet by the supported protrusion being guided to the support hole.

(14)

The information output device according to any one of (8) to (13) above, in which a part of the band part is provided as a regulating part configured to regulate movement of the urging magnet in a direction separating from the positioning magnet.

REFERENCE SIGNS LIST

1 Information output device
4 Slide part
5 Band part
11 Holding magnet
18*a* Arrangement space
20 Opening formation surface part
20*a* Opening
22*a* Lock part
23 Guide part
24 Regulating part
25 Shortest position magnet
27 Magnet holder
28 Positioning magnet
30*a* Support protrusion
30*b* Locked protrusion
32 Holding member
33 Urging magnet
34*b* Support hole

The invention claimed is:

1. An information output device, comprising:

an information output unit configured to output information;

a band part, wherein the band part has a length that is adjustable; and a slide part movable with respect to the band part in a length direction of the band part, wherein the slide part is attached with a holding magnet, the band part includes a positioning magnet different from the holding magnet, the positioning magnet is configured to attract the holding magnet in a state in which the length of the band part is adjusted, and the positioning magnet is movable with respect to the band part in the length direction of the band part.

2. The information output device according to claim 1, wherein the positioning magnet is further configured to attract the holding magnet in a state in which the holding magnet faces the positioning magnet in a thickness direction of the information output device.

3. The information output device according to claim 1, wherein the band part further includes a guide part, and the guide part is configured to guide the positioning magnet at a time of movement of the positioning magnet.

4. The information output device according to claim 1, wherein the band part further includes an arrangement space and an opening, the arrangement space includes at least a part of the positioning magnet, and the opening communicates with the arrangement space and enables an operation for the positioning magnet.

5. The information output device according to claim 4, wherein the band part is mountable on a body, the band part further includes an opening formation surface part, the opening formation surface part includes the opening, and the opening formation surface part is on a side, of the band part, in contact with the body.

6. The information output device according to claim 1, wherein the band part further includes a shortest position magnet, and the shortest position magnet is configured to attract the holding magnet in a state in which the length of the band part is shortest.

7. The information output device according to claim 6, wherein the shortest position magnet is further configured to attract the holding magnet in a state in which the holding magnet faces the shortest position magnet in a thickness direction of the information output device.

8. The information output device according to claim 1, further comprising an urging magnet having a repulsive force against the positioning magnet, wherein the urging magnet is configured to press the positioning magnet against the band part.

9. The information output device according to claim 8, wherein the positioning magnet and the urging magnet are integrally movable in the length direction of the band part.

10. The information output device according to claim 8, wherein the band part further includes a lock part configured to lock the positioning magnet, the positioning magnet is movable in a direction towards the urging magnet and in a direction away from the urging magnet, and the positioning magnet is further configured to:

lock the lock part and the positioning magnet by the repulsive force of the urging magnet; and move in the direction towards the urging magnet to unlock the lock part from the positioning magnet.

11. The information output device according to claim 10, further comprising a plurality of lock parts, wherein the plurality of lock parts includes:

a first lock part; and a second lock part apart from the first lock part in the length direction of the band part.

12. The information output device according to claim 10, further comprising a magnet holder configured to hold the positioning magnet, wherein the lock part is a recess, and the magnet holder includes a locked protrusion, and the locked protrusion is insertable into the lock part.

13. The information output device according to claim 12, further comprising a holding member configured to hold the urging magnet, wherein the holding member includes a support hole, the magnet holder further includes a supported protrusion, the supported protrusion is insertable into the support hole, and the positioning magnet is further configured to move in each of the direction towards the urging magnet and the direction away from the urging magnet based on insertion of the supported protrusion to the support hole.

14. The information output device according to claim 8, wherein the band part further includes a regulating part configured to regulate movement of the urging magnet in a direction towards the positioning magnet and a direction away from the positioning magnet.

15. An information output device, comprising:

an information output unit configured to output information;

a band part, wherein the band part has a length that is adjustable;

a slide part movable with respect to the band part in a length direction of the band part, wherein the slide part is attached with a holding magnet, the band part includes a positioning magnet different from the holding magnet, the positioning magnet is configured to attract the holding magnet in a state in which the length of the band part is adjusted, and the positioning magnet is movable with respect to the band part in the length direction of the band part; and an urging magnet that has a repulsive force against the positioning magnet, wherein the urging magnet is configured to press the positioning magnet against the band part.

* * * * *